US008902716B2

(12) United States Patent
Maruyama

(10) Patent No.: US 8,902,716 B2
(45) Date of Patent: Dec. 2, 2014

(54) SENSITIVITY ADJUSTMENT DEVICE, RADIO WAVE COMMUNICATION DEVICE AND WATCH

(75) Inventor: Yoshihiro Maruyama, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 372 days.

(21) Appl. No.: 13/495,801

(22) Filed: Jun. 13, 2012

(65) Prior Publication Data

US 2012/0320715 A1 Dec. 20, 2012

(30) Foreign Application Priority Data

Jun. 17, 2011 (JP) ..... 2011-134813
Jun. 17, 2011 (JP) ..... 2011-134815
Aug. 29, 2011 (JP) ..... 2011-185764

(51) Int. Cl.

| | |
|---|---|
| ***G04B 43/00*** | (2006.01) |
| ***G04R 60/12*** | (2013.01) |
| ***H01Q 3/20*** | (2006.01) |
| ***H01Q 1/52*** | (2006.01) |
| ***H01Q 1/27*** | (2006.01) |

(52) U.S. Cl.

CPC ..... *G04R 60/12* (2013.01); *H01Q 3/20* (2013.01); *H01Q 1/526* (2013.01); *H01Q 1/273* (2013.01)

USPC ..... 368/47; 368/293; 368/295

(58) Field of Classification Search

USPC ..... 368/47, 293–295

See application file for complete search history.

(56) References Cited

U.S. PATENT DOCUMENTS

| | | | | |
|---|---|---|---|---|
| 6,934,222 | B2 * | 8/2005 | Fujimori | 368/204 |
| 8,259,024 | B2 * | 9/2012 | Abe | 343/788 |
| 8,328,415 | B2 * | 12/2012 | Kachi et al. | 368/281 |
| 8,493,817 | B2 * | 7/2013 | Baba | 368/47 |
| 8,562,207 | B2 * | 10/2013 | Matsuzaki | 368/281 |
| 2008/0013601 | A1 | 1/2008 | Lind et al. | |
| 2012/0170423 | A1 * | 7/2012 | Fujisawa | 368/10 |
| 2013/0051181 | A1 * | 2/2013 | Fujisawa | 368/14 |

FOREIGN PATENT DOCUMENTS

| | | | |
|---|---|---|---|
| JP | 2004-117167 | A | 4/2004 |
| JP | 2007-536852 | A | 12/2007 |
| JP | 2009-079998 | A | 4/2009 |

OTHER PUBLICATIONS

Chinese Office Action dated Feb. 8, 2014 (and English translation thereof) in counterpart Chinese Application No. 201210202019.5.

* cited by examiner

*Primary Examiner* — Sean Kayes

(74) *Attorney, Agent, or Firm* — Holtz, Holtz, Goodman & Chick PC

(57) ABSTRACT

A sensitivity adjustment device adjusts radio wave sensitivity of an antenna which wirelessly transmits/receives a signal to/from an external device. The sensitivity adjustment device includes a case and a ring-shaped rotating member. The case houses the antenna. The rotating member is disposed on the outside of the case in such a way as to be rotatable. The rotating member includes (a) a shielding part which shields a radio wave and (b) a penetration part which allows penetration of a radio wave. A positional relationship between (a) the antenna and (b) the shielding part and the penetration part is changed by rotation of the rotating member so that the radio wave sensitivity of the antenna is adjusted.

20 Claims, 35 Drawing Sheets

SENSITIVITY ADJUSTMENT DEVICE, RADIO WAVE COMMUNICATION DEVICE AND WATCH

BACKGROUND OF THE INVENTION

1. Field of the Invention

The present invention relates to a sensitivity adjustment device, and a radio wave communication device and a watch to each of which the sensitivity adjustment device is applied.

2. Description of the Related Art

In recent years, there have been spread of methods for transmitting and receiving (communicating) various data between electronic devices such as watches each having a wireless communication function, for example, to exchange data between the electronic devices, and to synchronize information therebetween, by a wireless system.

It is possible that data transmitted and received by wireless communications includes many pieces of personal information. Hence, it is necessary to accurately transmit/receive data from a particular electronic device to another particular electronic device in order to protect personal privacy or the like.

However, when there is a plurality of electronic devices around a user, it is possible that an electronic device of the user (main electronic device) cannot have wireless communications with another electronic device with which the main electronic device intends to have the wireless communications (intended electronic device) because the main electronic device causes interference with another electronic device with which the main electronic device does not intend to have the wireless communications (unintended electronic device). In particular, when communications are made in accordance with Bluetooth® which handles radio waves having a long wavelength, the radio waves are not blocked by obstacles, and hence a main electronic device easily causes interference with an unintended electronic device.

Conventionally, as a method for a main electronic device to appropriately establish pairing (namely, an initial recognition operation) with an intended electronic device in a wireless communication system, avoiding interference from an unintended electronic device, for example, U.S. Patent Application Publication No. US 2008/0013601 A1 proposes (i) disposing electronic devices (a main electronic device and an intended electronic device), which are desired to establish pairing with each other, close to each other, (ii) making a query signal, which has an electric power level limited to being smaller than the standard signal output electric power level in a wireless communication system, transmitted from one of the electronic devices, (iii) making an answer signal for the query signal transmitted from the other thereof when the other thereof detects the query signal, and (IV) starting a point-to-point connection between the electronic devices based on a fact that the other thereof answers the query signal first.

When pairing is performed by such a method, a main electronic device can establish pairing only with an intended electronic device, avoiding causing interference with an unintended electronic device.

However, electronic devices transmit and receive data therebetween for various purposes. There are other cases than the case where electronic devices are disposed close to each other to the extent of contacting with each other so as to communicate with each other for pairing or the like. For example, electronic devices having a short distance therebetween transmit/receive various data therebetween, the electronic devices being a portable terminal device and a watch or the like both of which a user wears. Furthermore, electronic devices expected to have some distance therebetween transmit/receive data therebetween, for example, so as to find whereabouts of one of the electronic devices, the one which a user has left somewhere (search function).

Therefore, it is required that sensitivity (reception) of an electronic device to radio waves (radio wave sensitivity) is changed in accordance with its purpose, use, state or the like when the electronic device transmits/receives data to/from another electronic device.

In a mobile phone, a personal computer or the like, the radio wave sensitivity is changed in a communication-related module such as a reception circuit.

In the case where the radio wave sensitivity is changed in a communication-related module, the control mechanism of the module becomes complicated.

BRIEF SUMMARY OF THE INVENTION

The present invention is made in view of the circumstances, and objects of the present invention are to provide a sensitivity adjustment device which can adjust radio wave sensitivity of an antenna in accordance with its use with a simple mechanism, and to provide a radio wave communication device and a watch to each of which the sensitivity adjustment device is applied.

According to an aspect of the present invention, there is provided a sensitivity adjustment device, which adjusts radio wave sensitivity of an antenna wirelessly transmitting/receiving a signal to/from an external device, the sensitivity adjustment device including: a case which houses the antenna; and a ring-shaped rotating member disposed on the outside of the case in such a way as to be rotatable, the rotating member including (a) a shielding part which shields a radio wave and (b) a penetration part which allows penetration of a radio wave, wherein a positional relationship between (a) the antenna and (b) the shielding part and the penetration part is changed by rotation of the rotating member so that the radio wave sensitivity of the antenna is adjusted.

DETAILED DESCRIPTION OF THE INVENTION

[First Embodiment]

In the following, referring to FIGS. 1 to 6, a sensitivity adjustment device and a watch including the sensitivity adjustment device in accordance with a first embodiment of the present invention is described. Although, in the following, the sensitivity adjustment device of the present invention is applied to a watch having a function as a radio wave communication device, embodiments to which the sensitivity adjustment device is applicable are not limited thereto.

Figure 1:
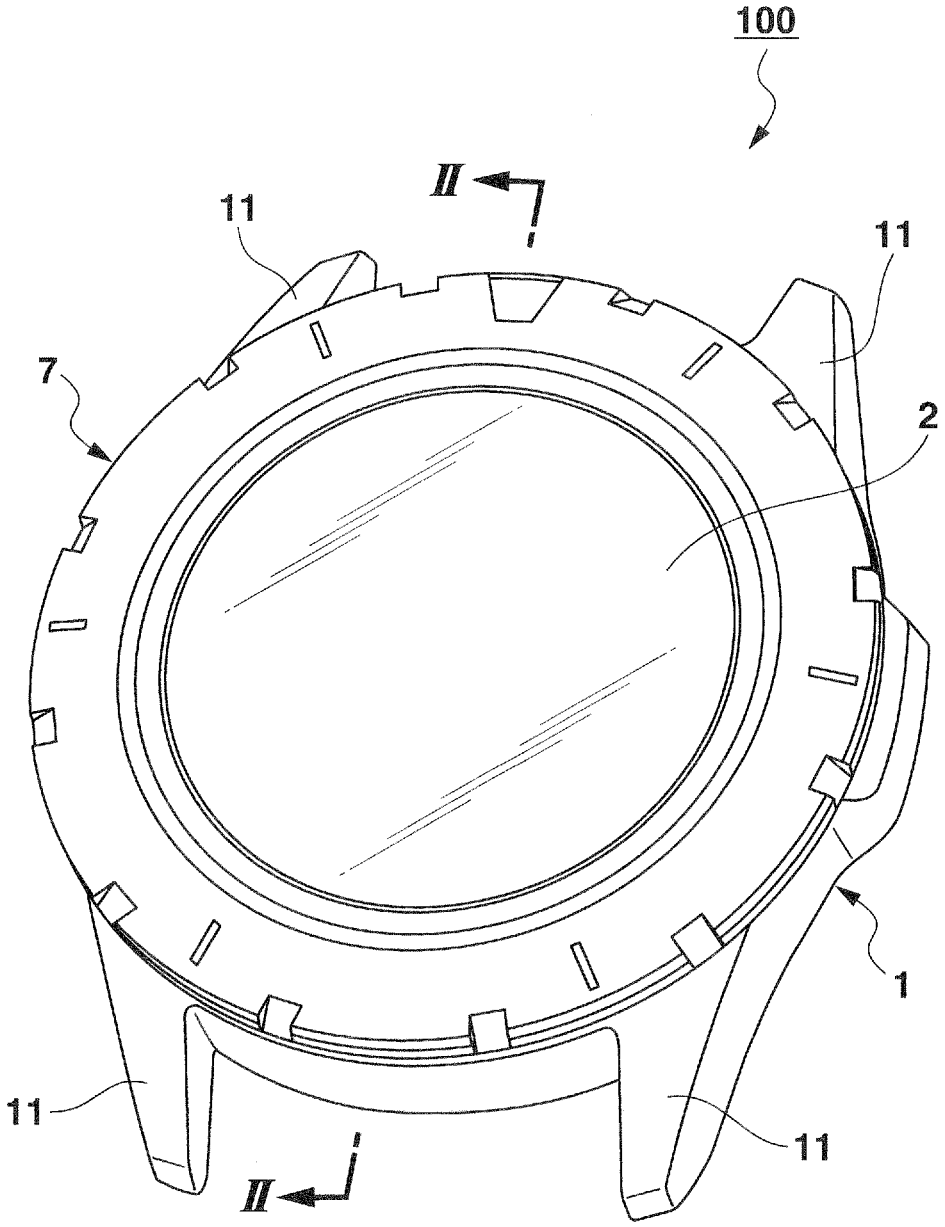
FIG. 1 is a front view of a watch to which a sensitivity adjustment device in accordance with a first embodiment of the present invention is applied.
Figure 2:
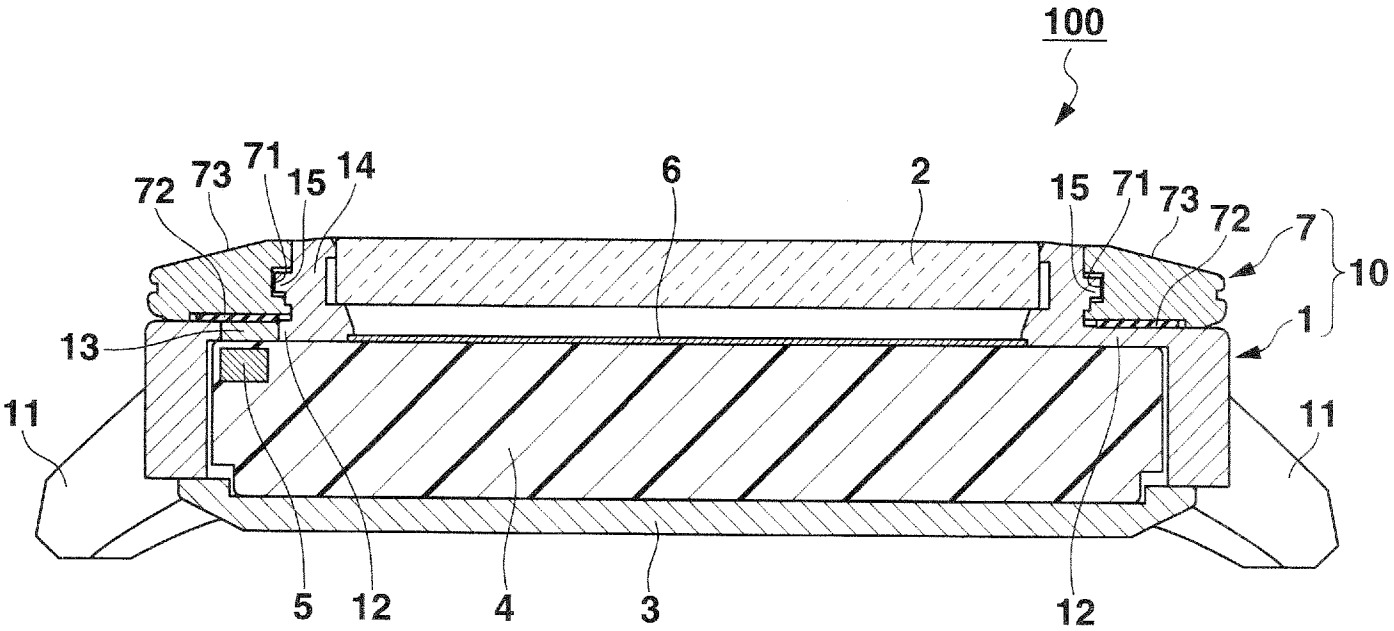
FIG. 2 is a sectional view of the watch taken along the line II-II of FIG. 1.
Figure 3:
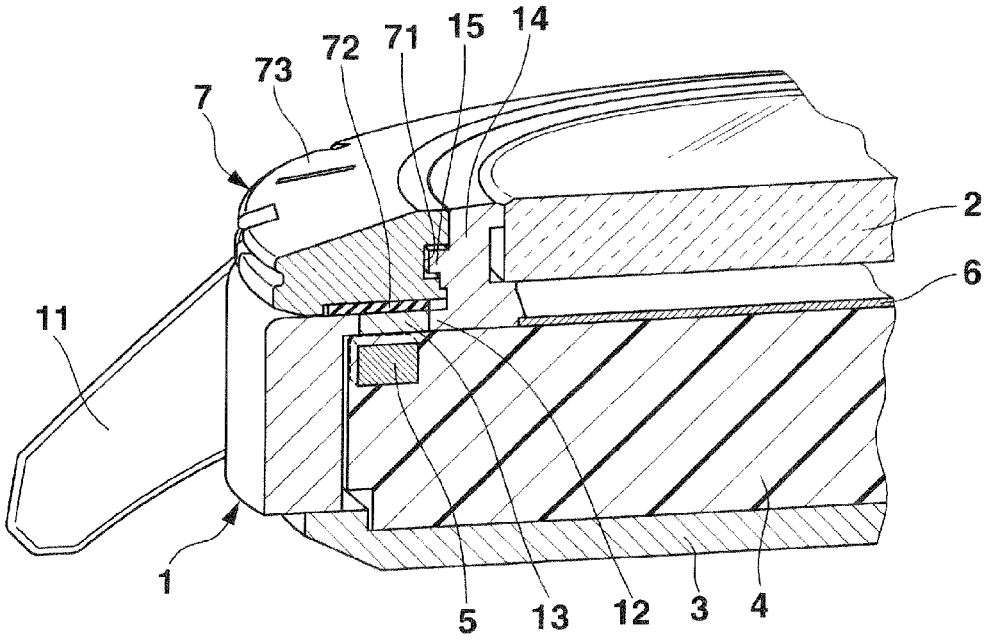
FIG. 3 is a main-part sectional view of the watch shown in FIG. 1, the position for six o'clock and its vicinity of the watch being enlarged.

FIG. 1 is a front view of a watch in accordance with the first embodiment. FIG. 2 is a sectional view of the watch taken along the line II-II of FIG. 1. FIG. 3 is a main-part sectional view of the watch shown in FIG. 1, the position for six o'clock of the watch being enlarged.

A watch 100 in the first embodiment rotates not-shown hands (a second hand, a minute hand and an hour hand) by electric drive so as to display time. In FIGS. 1 to 3, the hands and the like are not shown.

The watch 100 includes a case 1 formed in the shape of a short column, the inside of which is hollow. In the first embodiment, the case 1 is made of, for example, a metallic material such as stainless or titanium. It is not necessary that the case 1 is made of a metallic material, and hence the case 1 may be made of resin or the like.

Strap attachment parts 11 where a watchstrap (not shown) is attached are formed at points on the outer surface of the watch case 1, the points corresponding to the positions for twelve o'clock and six o'clock of the watch 100 (namely, the upper and lower ends in FIG. 1). A watch stem, an operation button, and the like (all not shown) are provided on a side part of the case 1.

Furthermore, the case 1 includes a back-side opening part on the back side (the lower side in FIG. 2) thereof. A back-side cover 3 is fitted to the back-side opening part so as to cover/close the back-side opening part via a not-shown waterproof ring or the like.

The outer circumference part of the upper part (the front side of the watch 100; the lower side in FIG. 2) of the case 1 constitutes a rotating bezel placing part 12. The rotating bezel placing part 12 is formed to have a width being approximately the same as that of a rotating bezel 7 (described below), be almost horizontally, and be in the shape of a flat plate.

A radio wave penetration part 13 which allows penetration of radio waves is formed as a part of the rotating bezel placing part 12 at the position for six o'clock of the watch 100. The radio wave penetration part 13 is formed, for example, by notching a part of the case 1 made of a metallic material, and inserting a member made of a material which allows penetration of radio waves, such as resin or glass, into the notch. However, this is not limit. The radio wave penetration part 13 may be formed by carving a part of the case 1 so as to make the part thinner to the extent that radio waves can penetrate. If the case 1 is made of a material which allows penetration of radio waves, such as resin, it is not necessary to provide the radio wave penetration part 13.

A standing part 14 is formed inside the rotating bezel placing part 12 on the upper part of the case 1 (namely, the upper side in FIG. 2). The standing part 14 projects to the front side of the watch 100. The upper part of the standing part 13 is open, so that a front-side opening part on the front side of the case 1 (the upper side in FIG. 2) is formed.

A windshield 2 made of a transparent material which allows penetration of radio waves, such as glass, is fitted to the front-side opening part so as to cover/close the front-side opening part via a not-shown waterproof ring or the like. On the outer circumferential surface of the standing part 14, a sword guard part 15 is formed along the circumferential direction. The sword guard part 15 is fitted into a groove 71 of the rotating bezel 7 described below.

A module 4 which is formed to be approximately columnar is disposed in the case 1. The module 4 is a unit to control radio wave transmission/reception of an antenna 5 (described below), and to display time. The module 4 is formed in such a way that a not-shown timepiece movement (for example, a driving motor, a gear train mechanism, or the like), a not-shown circuit substrate having various electronic components thereon, and the like are housed in a not-shown housing made of resin or the like. The timepiece movement, moves the not-shown hands of the watch 100.

As shown in FIGS. 2 and 3, at a point inside the case 1, the point approximately corresponding to the position for six o'clock of the watch 100 (a position at the lower side in FIG. 1), a small chip or loop antenna 5 is housed. In the first embodiment, the antenna 5 is disposed under the radio wave penetration part 13 provided in the rotating bezel placing part 12 of the case 1.

The antenna 5 is fixed to, for example, the upper side of the module 4 (the front side of the watch 100) with an adhesive agent or the like. The antenna 5 may be attached to the surface of the module 4, or embedded in the module 4.

The position where the antenna 5 is disposed is not limited to the positions described herein, and hence may be another position. When the antenna 5 is disposed at a different position, the radio wave penetration part 13 is disposed at a position in the rotating bezel placing part 12, the position corresponding to the position of the antenna 5.

The antenna 5 wirelessly transmits/receives signals to/from an external device in accordance with a standard such as Bluetooth®. The communication standard and the communicable frequency band of the antenna 5 are not limited to Bluetooth®, and hence appropriately selected so as to be suitable for each communication (namely, suitable for the frequency or the like of each communication) carried out by the watch 100. In addition, as long as the antenna 5 is small, its type and shape are not particularly limited. Furthermore, as described below, in the first embodiment, an antenna having the maximum radio wave sensitivity with which transmission/reception of signals to/from a device located within a distance of about 5 m from the antenna is available is used as the antenna 5. However, the radio wave sensitivity of the antenna 5 is not limited thereto, and hence an antenna having the maximum radio wave sensitivity with which transmission/reception of signals to/from a device located further is available may be used as the antenna 5.

The antenna 5 is electrically connected with a circuit substrate via a not-shown connector or the like, thereby being connected with a not-shown transmission/reception control circuit disposed on the circuit substrate in the module 4, via the connector.

In the first embodiment, the antenna 5 and the not-shown transmission/reception control circuit themselves always maintain the maximum radio wave sensitivity (for example, the radio wave sensitivity with which transmission/reception of radio waves are available within a distance of about 5 m from the antenna 5, in the first embodiment), and the radio wave sensitivity of the antenna 5 is mechanically adjusted by changing a covered area of the antenna 5 covered with a sensitivity adjustment device 10 (shown in FIG. 2).

A dial plate 6 is disposed between the windshield 2 and the module 4 in the case 1. Between the windshield 2 and the module 4, for example, a liquid crystal display section which displays numbers, letters and the like by a digital system may be disposed in addition to the analog-system dial plate 6.

The ring-shaped rotating bezel 7 is disposed on the rotating bezel placing part 12 of the case 1 along the outer circumferential edge of the case 1. The rotating bezel 7 is made of a material which allows penetration of radio waves, such as resin, and disposed in such a way that a part of the rotating bezel 7 covers the antenna 5 (shown in FIGS. 2 and 3) accommodated in the case 1. The material of the rotating bezel 7 is not limited to resin.

The rotating bezel 7 includes the groove 71 at a position corresponding to the position of the sword guard part 15 so as to fit with the sword guard part 15. The rotating bezel 7 is fixed onto the rotating bezel placing part 12 by fitting the groove 71 with the sword guard part 15 from outside. The rotating bezel 7 is rotatable with its center as a rotation center (namely, in the circumferential direction of the case 1, in the first embodiment). In order to rotate the rotating bezel 7, a user holds the outer circumferential edge of the rotating bezel 7 and rotates the rotating bezel 7 in a desired direction (clockwise or counterclockwise).

Figure 4:
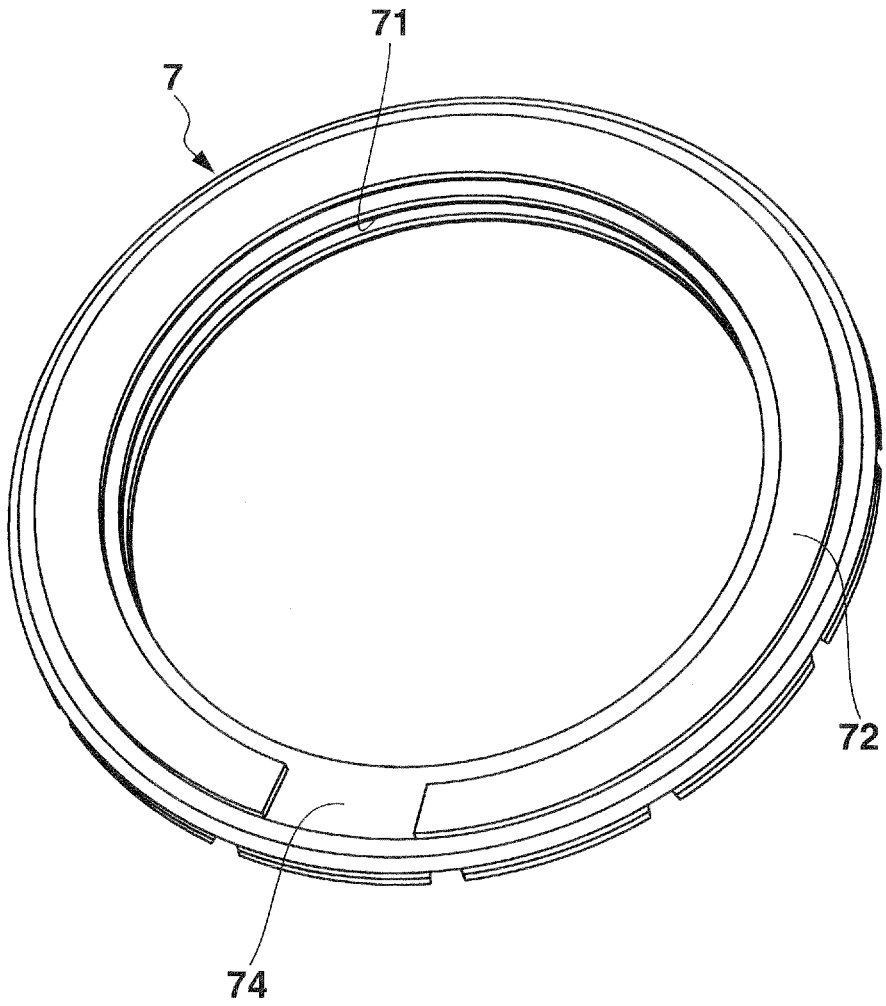
FIG. 4 is a perspective view showing a rotating bezel in accordance with the first embodiment.

FIG. 4 is a perspective view of the rotating bezel 7 viewed from the back side thereof (the side facing the rotating bezel placing part 12; the back-side cover 3 side of the watch 100).

As shown in FIG. 4, onto the back side of the rotating bezel 7, a magnetic sheet 72 is attached along the circumferential direction of the rotating bezel 7. The magnetic sheet 72 is a magnetic substance formed by processing a magnetic material such as ferrite or a material including magnetic powder into the shape of a sheet.

In the first embodiment, the magnetic sheet 72 is approximately in the shape of "C" formed, for example, by cutting a part of a ring-shaped sheet.

The magnetic sheet 72 shields radio waves which attempt to enter the antenna 5 by absorbing the radio waves with magnetic loss of the magnetic material of the magnetic sheet 72. Of the rotating bezel 7, a part where the magnetic sheet 72 is attached is a shielding part which shields radio waves, and a part where the magnetic sheet 72 is not attached (namely, the part where the magnetic sheet 72 is cut) is a penetration part 74 which allows penetration of radio waves.

On the front side of the rotating bezel 7 (the visual confirmation side; the side facing the windshield 2 of the watch 100), an information display surface 73 is formed. The information display surface 73 is a slope which slopes down from the windshield 2 side to the back-side cover 3 side as approaching from the inner circumference side of the rotating bezel 7 to the outer circumference side thereof. On the information display surface 73, not-shown graduations or the like are formed. The gradations divide the rotating bezel 7 equally into 60 parts along the circumferential direction. The rotating bezel 7 functions as a timer or the like which counts time elapsed since a predetermined time by the hands pointing the gradations. The gradations or the like formed on the information display surface 73 of the rotating bezel 7 are not limited to the gradations or the like described herein. Furthermore, by forming a plurality of kinds of gradations or the like on the information display surface 73, a plurality of pieces of information may be displayed.

Furthermore, at a point on the information display surface 73, the point corresponding to the position of the penetration part 74 which allows penetration of radio waves, a sensitivity indicator (not shown) may be provided by printing, adhesion, deposition, carving or the like. The sensitivity indicator indicates that the point corresponds to the penetration part 74 which allows penetration of radio waves. By providing the sensitivity indicator, a user can easily confirm the positions of the shielding part and the penetration part 74 from the visual confirmation side of the watch 100, by looking at the sensitivity indicator. Even if a sensitivity indicator is not provided in addition to common gradations, by deciding a predetermined indicator for indicating the position of the penetration part 74 in advance, for example, by disposing the penetration part 74 at a point on the back side of the rotating bezel 7, the point corresponding to a gradation for "0" which is provided for the rotating bezel 7 being used as a timer, a user can easily confirm the positions of the shielding part and the penetration part 74 by looking at the gradation.

As described above, the rotating bezel 7 includes the shielding part which is a part where the magnetic sheet 72 is attached, and the penetration part 74 which is a part where the magnetic sheet 72 is not attached. The rotating bezel 7 is configured to be rotated in the circumferential direction of the case 1 by a user's operation, and accordingly change the positions of the shielding part and the penetration part 74, so as to adjust the covered area of the antenna 5 covered with the shielding part.

Figure 5:
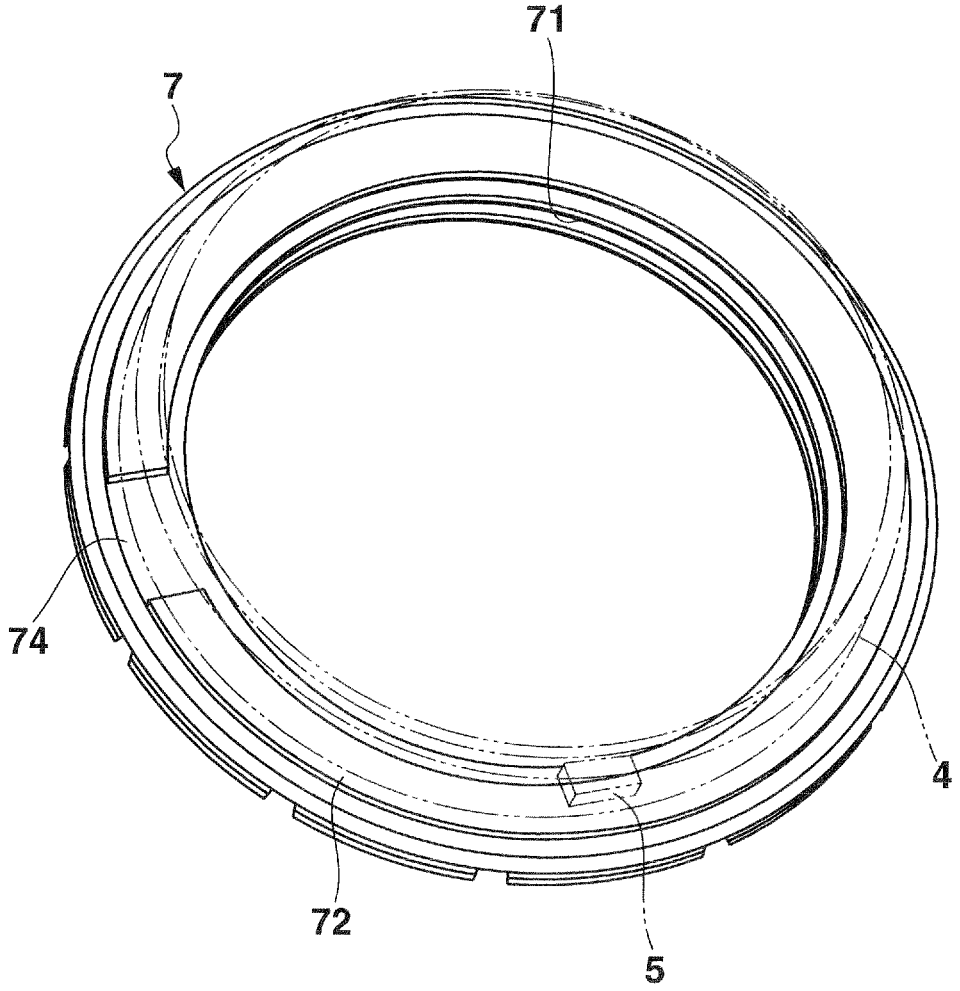
FIG. 5 is a perspective view showing a positional relationship between the rotating bezel shown in FIG. 4 and an antenna in a state in which the radio wave sensitivity of the antenna is low.
Figure 6:
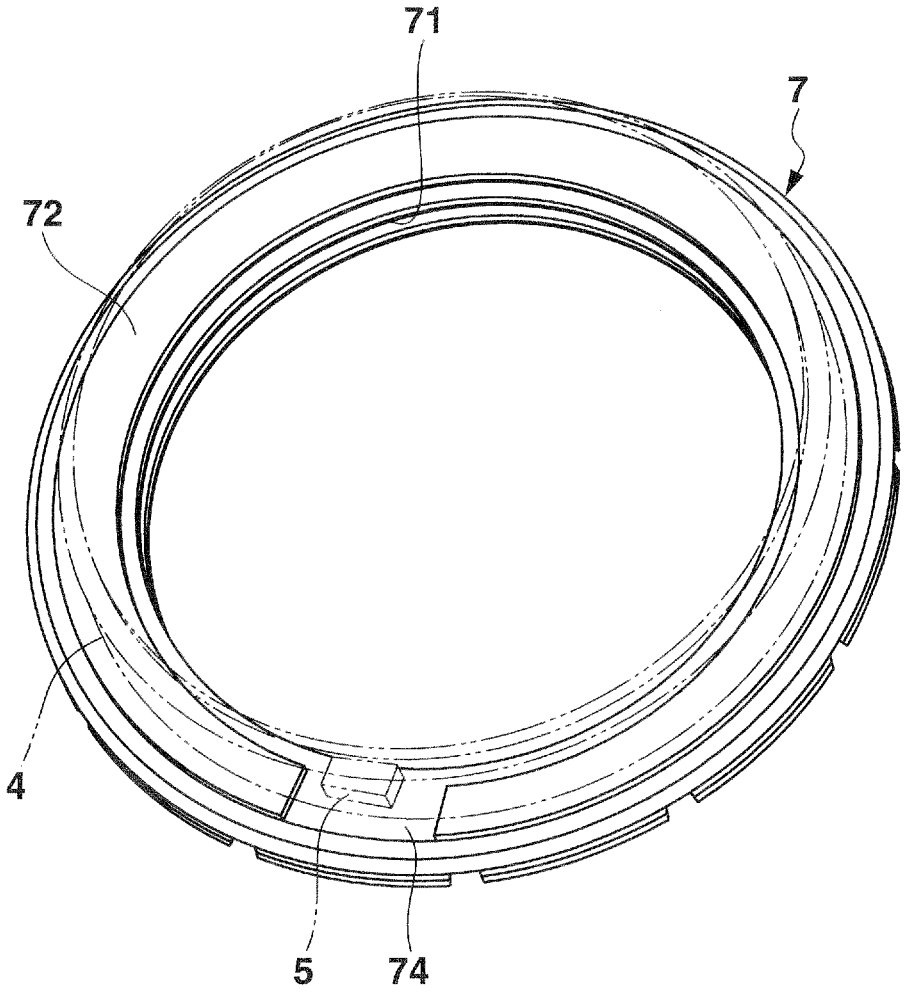
FIG. 6 is a perspective view showing a positional relationship between the rotating bezel shown in FIG. 4 and the antenna in a state in which the radio wave sensitivity of the antenna is high.

The adjustment of the covered area of the antenna 5 is described, referring to FIGS. 5 and 6. FIGS. 5 and 6 each show positions of the antenna fixed to the module 4 and the rotating bezel 7 viewed from the back side of the watch 100. The module 4 and the antenna 5 are shown by chain double-dashed lines, respectively.

As shown in FIG. 5, when the rotating bezel 7 is rotated by a user's operation so that the shielding part (namely, the part where the magnetic sheet 72 is attached) is over the antenna (namely, the position for six o'clock of the watch 100), the antenna 5 is covered with the magnetic sheet 72 (namely, the covered area of the antenna 5 becomes wide). Consequently, radio waves which attempt to enter the antenna 5 are absorbed by the magnetic sheet 72, and accordingly the radio wave sensitivity of the antenna 5 becomes low.

As shown in FIG. 6, when the rotating bezel 7 is rotated by a user's operation so that the penetration part 74 (namely, the part where the magnetic sheet 72 is not attached) is over the antenna 5 (namely, the position for six o'clock of the watch 100), the antenna 5 is not covered with the magnetic sheet 72 (namely, no covered area of the antenna 5 exists). Consequently, radio waves which attempt to enter the antenna 5 can easily enter the antenna 5, and accordingly the radio wave sensitivity of the antenna 5 becomes high.

In the first embodiment, the case 1, which houses the antenna 5, and the rotating bezel 7, which is disposed over the case 1 in such a way as to cover the antenna 5, constitute the sensitivity adjustment device 10 which adjusts the radio wave sensitivity of the antenna 5.

The watch 100 also includes: for example, a control section including an input operation section which switches various modes or the like, a CPU (Central Processing Unit), a ROM (Read Only Memory), and a RAM (Random Access Memory); a transmission/reception control circuit which controls transmission/reception of radio waves; a timer circuit which performs time correction and the like; an oscillation circuit; and a hand drive circuit which drives the hands. These are the same as those provided for a common watch, and hence the illustrations and description thereof are omitted.

Next, operations of the sensitivity adjustment device 10 and the watch 100 as a radio wave communication device in the first embodiment are described.

In the first embodiment, the watch 100 can adjust the radio wave sensitivity of the antenna 5 by adjusting the covered area of the antenna 5, with the sensitivity adjustment device 10.

That is, the watch 100 has a plurality of communication modes (in the first embodiment, the pairing mode, the data synchronization mode and the terminal search mode/losing prevention mode) executable under different radio wave sensitivity of the antenna 5, and the sensitivity adjustment device 10 adjusts the covered area of the antenna 5 in such a way that the radio wave sensitivity of the antenna 5 becomes suitable for each communication mode.

The communication modes are not limited thereto. For example, the present invention may have only one of the pairing mode, the data synchronization mode and the terminal search mode/losing prevention mode, or may have communication modes in addition to these three communication modes.

The pairing mode is a communication mode, for example, used by a user of the watch 100 to establish pairing (namely, to perform the initial registration operation to associate terminal devices with each other) between the watch 100 and a terminal device (a terminal device of a friend of the user, for example) so that the watch 100 can transmit/receive data to/from the terminal device. For example, in order to establish pairing between the watch 100 and a terminal device which is a mobile phone of the user's friend, the watch 100 transmits a query signal to the terminal device. When the terminal device transmits an answer signal for the query signal to the watch 100, and the antenna 5 of the watch 100 receives the answer signal and transmits the signal to the control section, the pairing is established between the watch 100 and the terminal device.

When communications are carried out in the pairing mode, in order not to establish unexpected pairing with a terminal device which exists around the watch 100 but is not a party for the pairing, it is preferable to adjust the radio wave sensitivity of the antenna 5 to be low to the extent that only when the watch 100 and a terminal device contact with each other or come close enough to almost contact with each other, transmission/reception of radio waves between the watch 100 and the terminal device is available.

Hence, in the first embodiment, when an instruction to select the pairing mode is inputted with the input operation section or the like, and communications are carried out in the pairing mode, the rotating bezel 7 is rotated in such a way that the shielding part, namely, the part where the magnetic sheet 72 is attached, of the rotating bezel 7 is disposed over the antenna 5, whereby the radio wave sensitivity of the antenna 5 is adjusted to be low.

More specifically, a user rotates the rotating bezel 7 to a point where the penetration part 74 is disposed at a position other than the position for six o'clock of the watch 100, whereby the shielding part (the part where the magnetic sheet 72 is attached) is adjusted to cover the antenna 5 (namely, at the position for six o'clock of the watch 100) (shown in FIG. 5).

In this state, when a user makes a terminal device which is a party for the pairing contact with the watch 100 or places the terminal device close to the watch 100, namely, within a distance of about 10 cm from the watch 100, a query signal for pairing (for example, a signal including an individual identification number or the like of the watch 100) is transmitted from the antenna 5 of the watch 100, and only a terminal device located within a distance in which the query signal can be received receives the query signal. The terminal device which receives the query signal returns an answer signal (for example, a signal including an individual identification number or the like of the terminal device) to the watch 100. When receiving the answer signal, the antenna 5 of the watch 100 transmits the answer signal to the control section of the watch 100. Then, the control section registers the terminal device as a terminal device which can transmit/receive data to/from the watch 100 thereafter. Thus, pairing (initial registration operation between terminal devices) is completed.

It is preferable that a user is informed about establishment of pairing and/or failure of pairing by a message displayed with the hands, the liquid crystal display section or the like on the dial plate 6, flashing of a not-shown light, an alarm sound or the like.

Furthermore, in a case where pairing is not established between the watch 100 and a terminal device which is a party for the pairing (namely, in a case where a message or the like indicating failure of the pairing is displayed) in a state in which the radio wave sensitivity of the antenna 5 is low (namely, in a state in which the antenna 5 is covered with the magnetic sheet 72), pairing may be tried again. For that, a user rotates the rotating bezel 7 to a point where the penetration part 74 is disposed at the position for six o'clock of the watch 100, whereby the penetration part 74 (the part where the magnetic sheet 72 is not attached) is adjusted to cover the antenna 5. Then, pairing is tried again.

The data synchronization mode is a communication mode, for example, used by a user of the watch 100 to synchronize data thereof with data of a terminal device or the like which already establishes pairing with the watch 100 and is located relatively close to the watch 100 (for example, within a distance of about 1 m to 2 m from the antenna 5), for example, a terminal device which a user of the watch 100 wears (a not-shown mobile phone or the like which the user carries).

The terminal search mode is a communication mode, for example, used by a user of the watch 100 to search for a terminal device of the user or a friend of the user, the terminal device which already establishes pairing with the watch 100. The losing prevention mode is a communication mode, for example, used by a user of the watch 100 to be given a warning by a buzzer sound or the like when the user is a predetermined distance (for example, about 5 m) or more away from a terminal device of the user, the terminal device which already establishes pairing with the watch 100.

Communications in these modes are communications between the watch 100 and a terminal device which already establishes pairing with the watch 100. Hence, there is no possibility that communications are established between the watch 100 and an unexpected terminal device.

Hence, in the first embodiment, when an instruction to select the data synchronization mode or the terminal search mode/losing prevention mode is inputted with the input operation section or the like, and communications are carried out in the mode, the rotating bezel 7 is rotated in such a way that the penetration part 74, namely, the part where the magnetic sheet 72 is not attached, of the rotating bezel 7 is disposed over the antenna 5, whereby the radio wave sensitivity of the antenna 5 is adjusted to be high.

More specifically, a user rotates the rotating bezel 7 to a point where the penetration part 74 is disposed at the position for six o'clock of the watch 100, whereby the penetration part 74 (the part where the magnetic sheet 72 is not attached) is adjusted to cover the antenna 5 (shown in FIG. 6).

Accordingly, the antenna 5 of the watch 100 can transmit/receive radio waves to/from a terminal device located a little away from the watch 100. For example, in the data synchronization mode, the watch 100 transmits/receives data to/from a mobile phone or the like which a user of the watch 100 wears, to synchronize its data with the data of the mobile phone or the like. Furthermore, in the terminal search mode, a query signal is transmitted from the antenna 5 of the watch 100 to a terminal device which already establishes pairing with the watch 100 and is located within a distance of about 5 m from the watch 100, the query signal which requires the terminal device to answer. When the terminal device receives the query signal, and transmits an answer signal to the watch 100, a user of the watch 100 is informed about that by a buzzer sound, flashing of a light or the like. Still further, in the losing prevention mode, a query signal is transmitted from the antenna 5 of the watch 100 to a terminal device which already establishes pairing with the watch 100, the query signal which requires the terminal device to answer. The terminal device receives the query signal, and transmits an answer signal to the watch 100. When not receiving the answer signal from the terminal device, the control section of the watch 100 judges that the terminal device is a predetermined distance (in the first embodiment, m, within which the antenna 5 can transmit/receive radio waves) or more away from the watch 100, and informs the user about that by a buzzer sound, flashing of a light or the like.

As described above, according to the first embodiment, a plurality of communication modes (the pairing mode, the data synchronization mode and the terminal search mode/losing prevention mode, for example) can be used under different radio wave sensitivity of the antenna 5. Accordingly, various communications can be carried out in accordance with a user's purpose or use of the watch 100.

The watch 100 in the first embodiment has a mechanical configuration as a method for adjusting the radio wave sensitivity of the antenna 5 to be suitable for the communication modes. That is, the watch 100 adjusts the radio wave sensitivity of the antenna 5 by rotating the rotating bezel 7 so as to adjust the covered area of the antenna 5 covered with the shielding part. Consequently, as compared with a case where the radio wave sensitivity is changed in a communication-related module such as a reception circuit, the watch 100 can reduce the electric power consumption for adjusting the radio wave sensitivity of the antenna 5.

Furthermore, a watch is expected to be small and have a light weight (miniaturized). Hence, it is difficult to secure a space to accommodate a large battery. However, the watch 100 in the first embodiment includes the sensitivity adjustment device 10 which includes: the case 1 holding the antenna 5; and the rotating bezel 7 disposed above the case 1 in such a way as to cover the antenna 5, and can adjust the radio wave sensitivity of the antenna 5 with a mechanical configuration. Consequently, as compared with the case where the radio wave sensitivity is changed in a communication-related module, the watch 100 can reduce the electric power consumption. Furthermore, because the electric power consumption can be reduced, it becomes unnecessary that the watch 100 accommodates a large battery or the like. Accordingly, miniaturization of a device can be achieved.

Furthermore, the radio wave sensitivity of the antenna 5 can be adjusted by rotating the rotating bezel 7 which has the shielding part and the penetration part 74. Accordingly, the radio wave sensitivity of the antenna 5 can be adjusted to be suitable for the communication modes without an additional component to adjust the radio wave sensitivity thereof, and hence simplification of a configuration of a device and miniaturization of a device can be achieved.

Furthermore, the shielding part is formed by attaching the magnetic sheet 72, which is the magnetic substance, to the back side of the rotating bezel 7. Accordingly, an existing standardized rotating bezel can be easily diverted into the rotating bezel 7, and hence manufacturing costs of the rotating bezel 7 and the watch 100 by extension can be reduced.

In the first embodiment, the magnetic sheet 72 as the magnetic substance is formed approximately in the shape of "C". However, the shape of the magnetic sheet 72 is not limited thereto.

Figure 7:
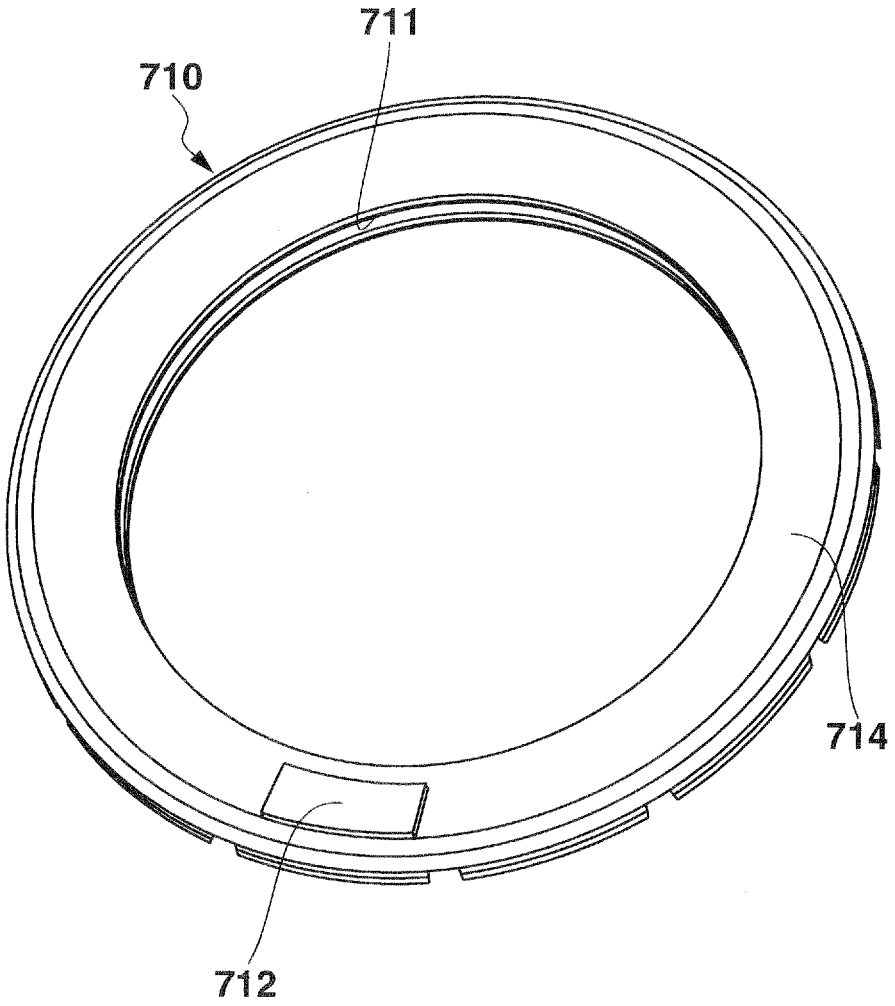
FIG. 7 is a plan view of a rotating bezel in accordance with a modification of the first embodiment.

For example, as shown in FIG. 7, only onto a part of the back side of a rotating bezel 710, a magnetic sheet 712 having the size with which the antenna 5 can be covered may be attached. In this case, the part where the magnetic sheet 712 is attached is the shielding part, and the rest is a penetration part 714.

Figure 8:
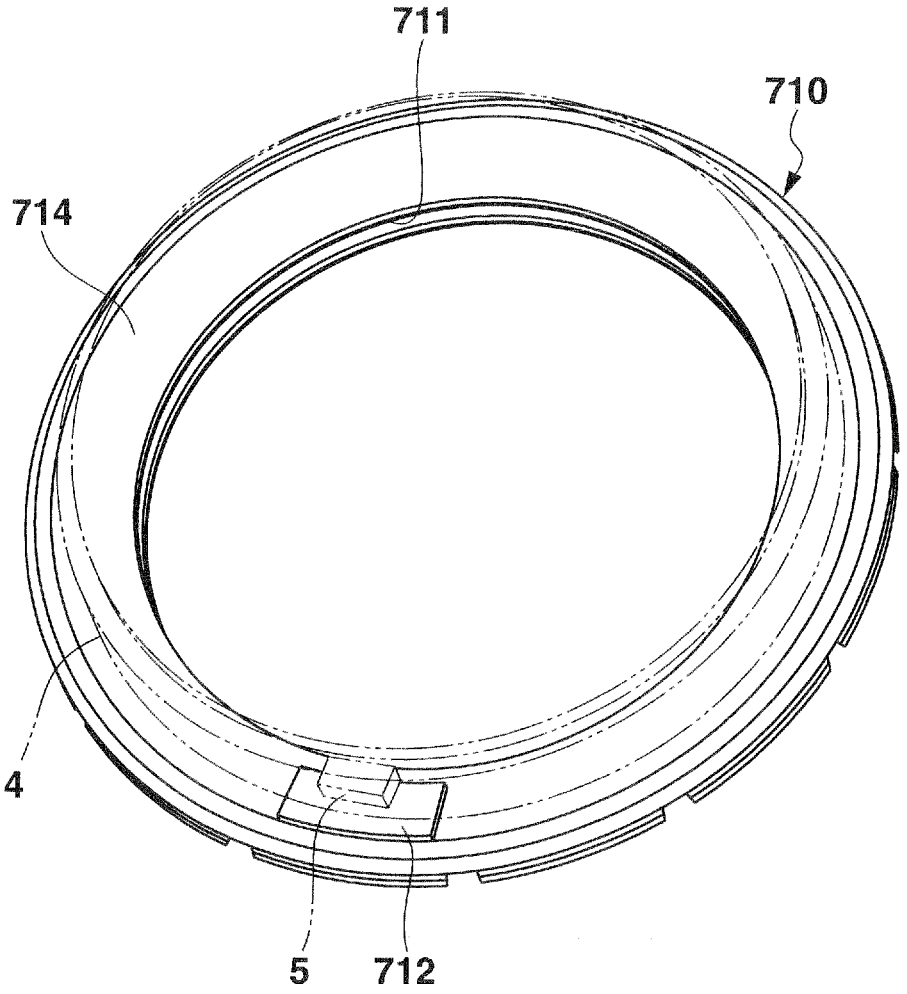
FIG. 8 is a perspective view showing a positional relationship between the rotating bezel shown in FIG. 7 and the antenna in a state in which the radio wave sensitivity of the antenna is low.
Figure 9:
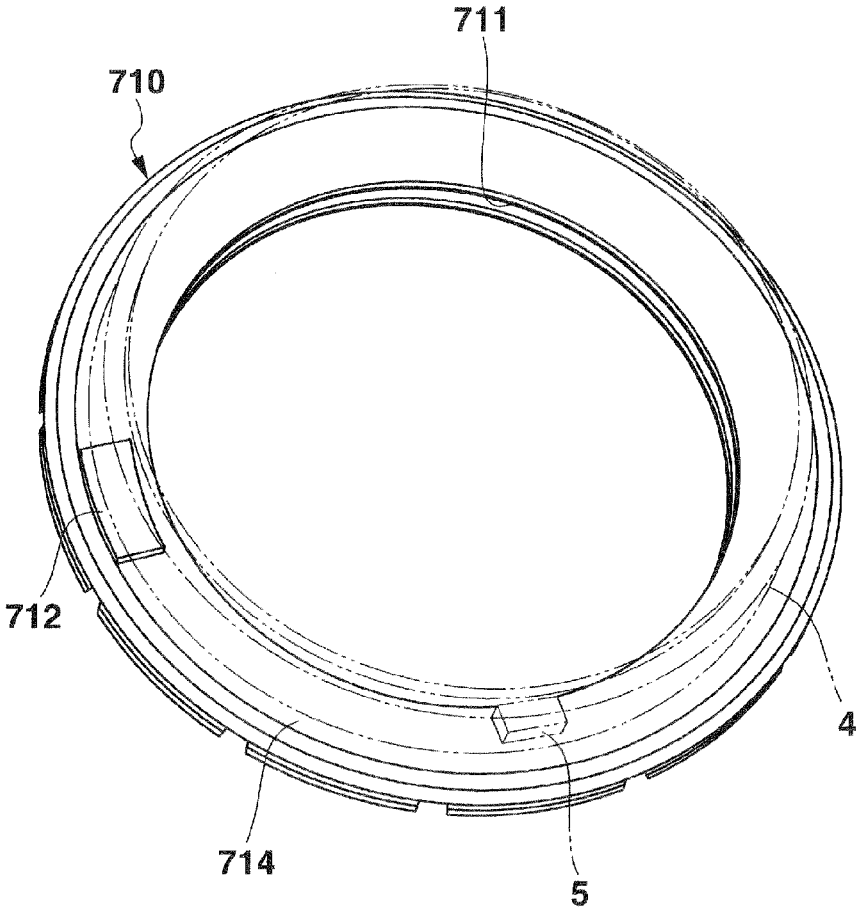
FIG. 9 is a perspective view showing a positional relationship between the rotating bezel shown in FIG. 7 and the antenna in a state in which the radio wave sensitivity of the antenna is high.

Therefore, when pairing is performed (namely, the pairing mode is set), as shown in FIG. 8, the rotating bezel 710 is rotated to a point where the part where the magnetic sheet 712 is attached covers the antenna 5. Accordingly, the radio wave sensitivity of the antenna 5 can be decreased to be suitable for the pairing mode. When pairing is not established between terminal devices in the state shown in FIG. 8, or when data of terminal devices which already establish pairing with each other are synchronized (namely, the data synchronization mode is set), or when a terminal device (the watch 100) searches for a terminal device which already establishes pairing with the watch 100 (namely, the terminal search mode/losing prevention mode is set), as shown in FIG. 9, the rotating bezel 710 is rotated to a point where the part where the magnetic sheet 712 is not attached covers the antenna 5. Accordingly, the radio wave sensitivity of the antenna 5 can be increased to the extent that even terminal devices which are apart from each other can transmit/receive radio waves with each other.

Furthermore, in the first embodiment, the magnetic sheet 72 attached to the rotating bezel 7 is the magnetic substance. However, the magnetic substance is not limited to being sheet-shaped. For example, the magnetic substance may be embedded in a part of the rotating bezel 7 so as to form the shielding part.

Furthermore, in the first embodiment, of the rotating bezel 7, the part where the magnetic sheet 72 as the magnetic substance is attached is the shielding part, and the part where the magnetic sheet 72 is not attached is the penetration part 74. However, the configurations of the shielding part and the penetration part are not limited thereto.

For example, a part of the rotating bezel 7 may be formed to be thicker than the rest as a thick part where penetration of radio waves is difficult as compared with the rest. In this case, the thick part is the shielding part, and the rest is the penetration part. It is preferable to add a sensitivity indicator at a point on the front side of the rotating bezel 7, the point corresponding to the position of the thick part. The sensitivity indicator indicates the position of the thick part, namely, the shielding part.

Even when the thick part is the shielding part and the rest is the penetration part, the radio wave sensitivity of the antenna 5 can be adjusted by a mechanical configuration. Furthermore, a large battery or the like is not needed for adjusting the radio wave sensitivity of the antenna 5. Accordingly, miniaturization of a device can be achieved.

Furthermore, it is possible to notch a part of a rotating bezel made of a metallic material, and put a member made of a material which allows penetration of radio waves, such as resin or glass, into the notch (or a hole). In this case, the part where the member made of a material which allows penetration of radio waves is put is the penetration part, and the rest is the shielding part.

[Second Embodiment]

In the following, referring to FIGS. 10 to 18, sensitivity adjustment device and a watch including the sensitivity adjustment device in accordance with a second embodiment of the present invention is described. Although, in the following, the sensitivity adjustment device of the present invention is applied to a watch having a function as a radio wave communication device, embodiments to which the sensitivity adjustment device is applicable are not limited thereto.

Figure 10:
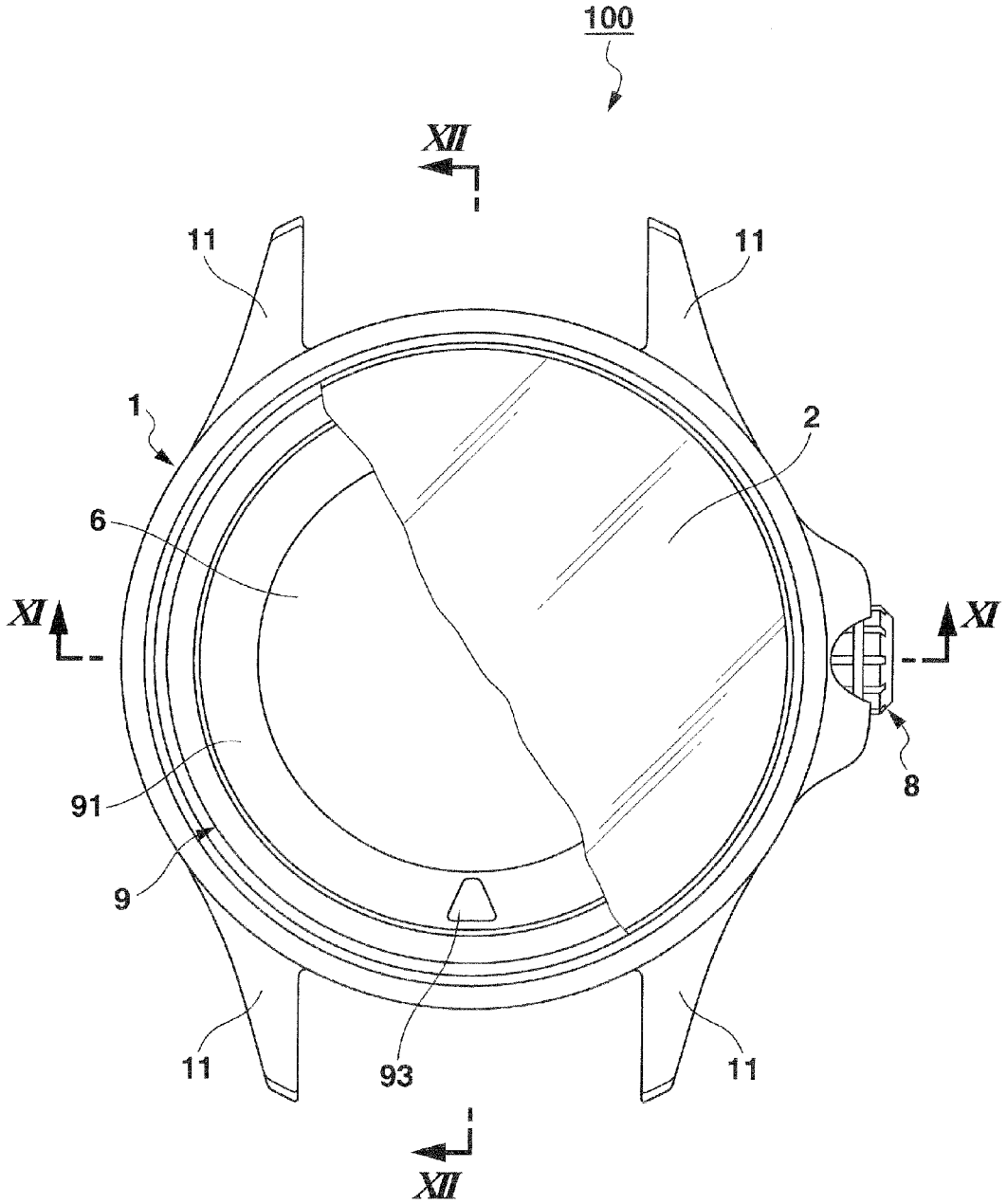
FIG. 10 is a front view of a watch to which a sensitivity adjustment device in accordance with a second embodiment of the present invention is applied.
Figure 11:
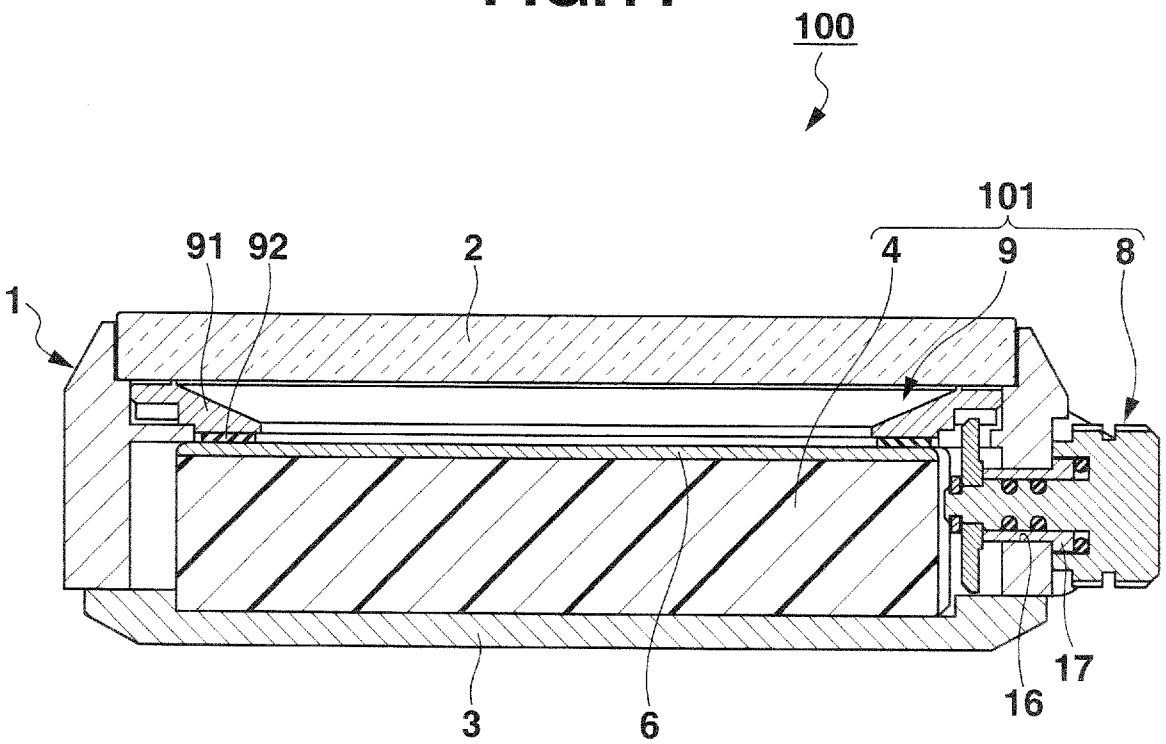
FIG. 11 is a sectional view of the watch taken along the line XI-XI of FIG. 10.
Figure 12:
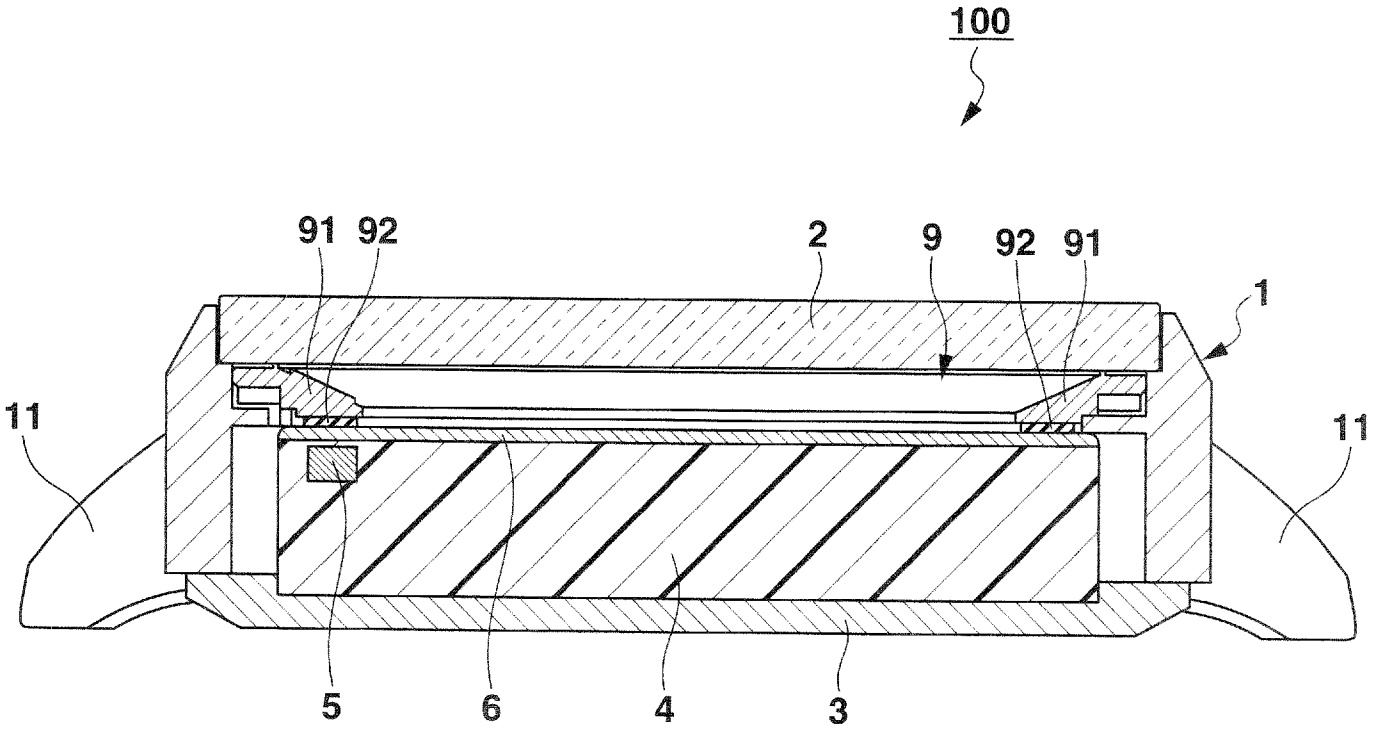
FIG. 12 is a sectional view of the watch taken along the line XII-XII of FIG. 10.

FIG. 10 is a front view of a watch in accordance with the second embodiment. FIG. 11 is a sectional view of the watch taken along the line XI-XI of FIG. 10. FIG. 12 is a sectional view of the watch taken along the line XII-XII of FIG. 10.

A watch 100 in the second embodiment rotates not-shown hands (a second hand, a minute hand and an hour hand) by electric drive so as to display time. In FIGS. 10 to 12, the hands and the like are not shown.

On the lateral surface of the case 1, a through hole 16 (shown in FIGS. 11 and 13) which passes through the case 1 is made. In the second embodiment, the through hole 16 is made at a point on the lateral surface of the case 1, the point corresponding to the position for three o'clock of the watch 100. However, this is not a limit. For example, the through hole 16 may be made at a point on the lateral surface of the case 1, the point corresponding to the position for nine o'clock or four o'clock of the watch 100.

Figure 13:
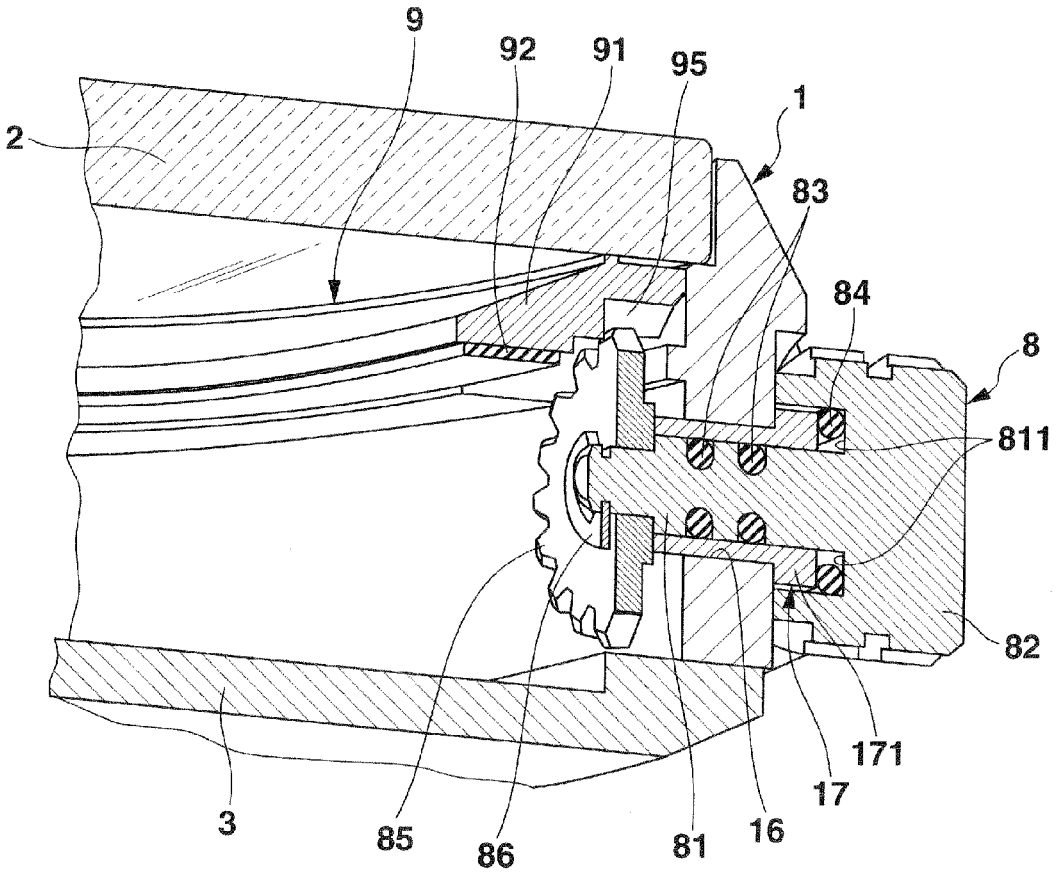
FIG. 13 is a main-part sectional view of the watch shown in FIG. 11, a rotating ring, a watch stem, and their vicinities of the watch being enlarged.

FIG. 13 is a main-part sectional view showing the through hole 16 and the vicinity thereof.

As shown in FIGS. 11 and 13, a tube-shaped member 17 is inserted into the through hole 16 from the outside of the case to the inside thereof. A fringe 171 having the outer diameter larger than the inner diameter of the through hole 16 is formed at one end of the tube-shaped member 17. When the tube-shaped member 17 is inserted into the through hole 16, the fringe 171 projects to the outside of the case 1.

As shown in FIG. 13, on a side part of the case 1, the side part where the through hole 16 is made, a watch stem 8 is disposed. The watch stem 8 is disposed to pass through the lateral surface of the case 1. The watch stem 8 functions as a rotation operation section which rotates a rotating ring 9 described below.

The watch stem 8 includes a shaft 81 and a watch stem top 82. The watch stem top 82 is formed at an end side of the shaft 81, and has the diameter larger than the inner diameter of the tube-shaped member 17.

The shaft 81 is inserted into the through hole 16 via the tube-shaped member 17, so as to pass through the case 1 from the outside to the inside thereof. The shaft 81 is formed to have the outer diameter almost equal to the inner diameter of the tube-shaped member 17 in the through hole 16. Around the middle of the shaft 81, circumferential grooves are formed along the outer circumferential surface of the shaft 18.

In the circumferential grooves, seal rings 83 each of which is a ring-shaped seal, such as an O-ring, are put. The seal ring 83 is made of, for example, resin or the like. The material of the seal ring 83 is not limited thereto.

When the watch stem 8 is rotated, the seal rings 83 rotate with the shaft 81, and slide on the inner circumferential surface of the tube-shaped member 17 while continuously contacting therewith in the circumferential direction. Consequently, air-tightness between the shaft 81 and the tube-shaped member 17 of the case 1 is secured.

On the inner side (namely, the side facing the lateral surface of the case 1) of the watch stem top 82, a groove 811 is formed along the outer circumference of the shaft 81. The fringe 171 of the tube-shaped member 17 is accommodated in the groove 811.

On the bottom of the groove 811, a seal ring 84 which is a ring-shaped seal, such as an O-ring, is put so that air-tightness between the tube-shaped member 17 and the watch stem top 82 is secured. The seal ring 84 is made of, for example, resin or the like. The material of the seal ring 84 is not limited thereto.

Near the insertion end part of the shaft 81, a ring drive gear wheel (pinion) 85 is provided. The ring drive gear wheel 85 rotates the rotating ring 9 described below. The ring drive gear wheel 85 is fixed to the shaft 81 by press fit or the like.

On the insertion tip part of the shaft 81, a fixing groove is formed along the outer circumferential surface of the shaft 81. A falling prevention member 86 which prevents the shaft 81 from falling off from the case 1 is fixed to the fixing groove. As the falling prevention member 86, for example, an E-shaped ring having the diameter larger than the inner diameter of the tube-shaped member 17 can be used. As long as preventing the shaft 81 from falling off from the case 1, the falling prevention member 86 is not limited to an E-shaped ring.

A module 4 which is formed to be approximately columnar is disposed in the case 1. The shape of the module 4 is not limited to being columnar. The module 4 is formed in such a way that a not-shown timepiece movement (for example, a driving motor, a gear train mechanism, or the like), a not-shown circuit substrate having various electronic components thereon, and the like are housed in a not-shown housing made of resin or the like. The timepiece movement moves the not-shown hands of the watch 100.

Figure 14:
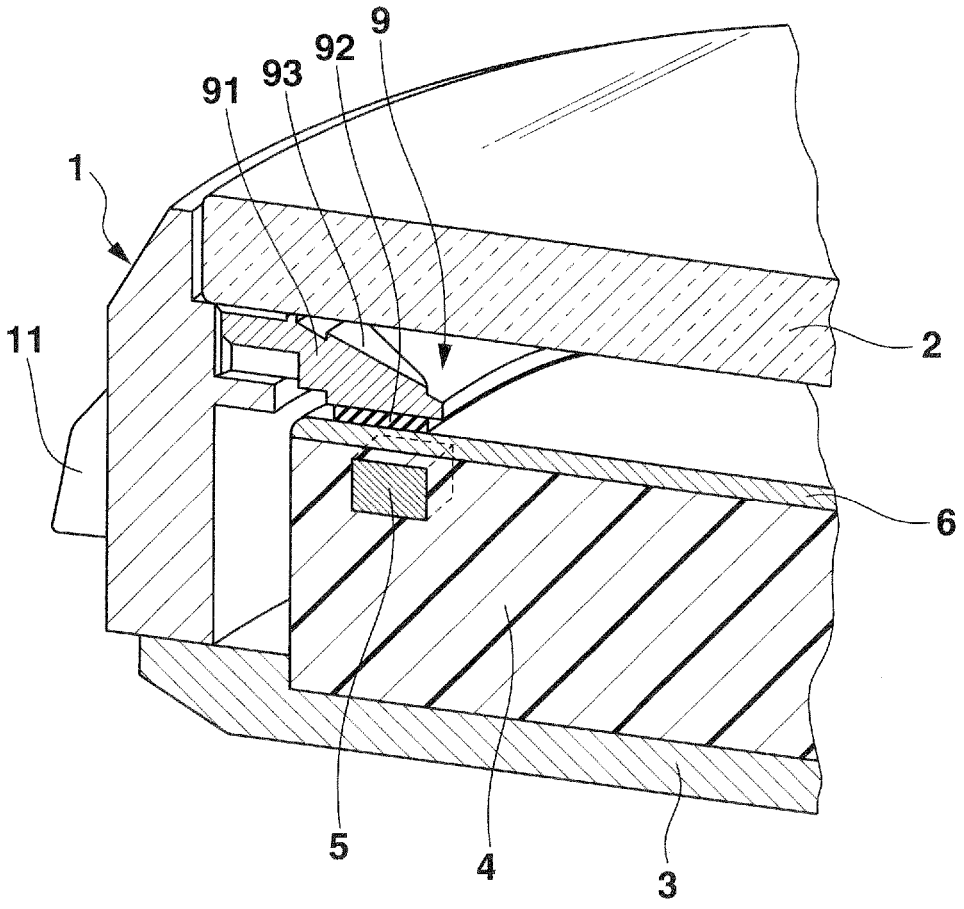
FIG. 14 is a main-part sectional view of the rotating ring, an antenna, and their vicinities shown in FIG. 12 being enlarged.

As shown in FIGS. 12 and 14, in the second embodiment, at a point on the circumferential part of the upper side of the module 4 (the front side of the watch 100), the point corresponding to the position for six o'clock of the watch 100 (a position at the lower side in FIG. 10), a small chip or loop antenna 5 is disposed.

The antenna 5 is held on the module 4, for example, by being fixed with an adhesive agent or the like. The antenna 5 may be attached to the surface of the module 4, or embedded in the module 4. The position where the antenna 5 is disposed is not limited to the positions described herein, and hence may be another position.

The antenna 5 wirelessly transmits/receives signals to/from an external device in accordance with a standard such as Bluetooth®. The communication standard and the communicable frequency hand of the antenna 5 are not limited to Bluetooth®, and hence appropriately selected so as to be suitable for each communication (namely, suitable for the frequency or the like of each communication) carried out by the watch 100. In addition, as long as the antenna 5 is small, its type and shape are not particularly limited. Furthermore, as described below, in the second embodiment, an antenna having the maximum radio wave sensitivity with which transmission/reception of signals to/from a device located within a distance of about 5 m from the antenna is available is used as the antenna 5. However, the radio wave sensitivity of the antenna 5 is not limited thereto, and hence an antenna having the maximum radio wave sensitivity with which transmission/reception of signals to/from a device located further is available may be used as the antenna 5.

The antenna 5 is electrically connected with a circuit substrate via a not-shown connector, and connected with a not-shown transmission/reception control circuit via the connector.

In the second embodiment, the antenna 5 and the not-shown transmission/reception control circuit themselves always maintain the maximum radio wave, sensitivity (for example, the radio wave sensitivity with which transmission/reception of radio waves are available within a distance of about 5 m from the antenna 5, in the second embodiment), and the radio wave sensitivity of the antenna 5 is mechanically adjusted by changing a covered area of the antenna 5 covered with a sensitivity adjustment device 101 (shown in FIG. 11).

A dial plate 6 is disposed between the windshield 2 and the module 4 in the case 1. Between the windshield 2 and the module 4, for example, a liquid crystal display section which displays numbers, letters and the like by a digital system may be disposed in addition to the analog-system dial plate 6.

On the dial plate 6, namely, over the module 4, a ring-shaped rotating ring 9 is disposed in such a way as to be rotatable with its center as the rotation center.

The rotating ring 9 is made of a material which allows penetration of radio waves, such as resin, and disposed in such a way that a part of the rotating ring 9 covers the antenna 5 held on the module 4. The material of the rotating ring 9 is not limited to resin.

Figure 15:
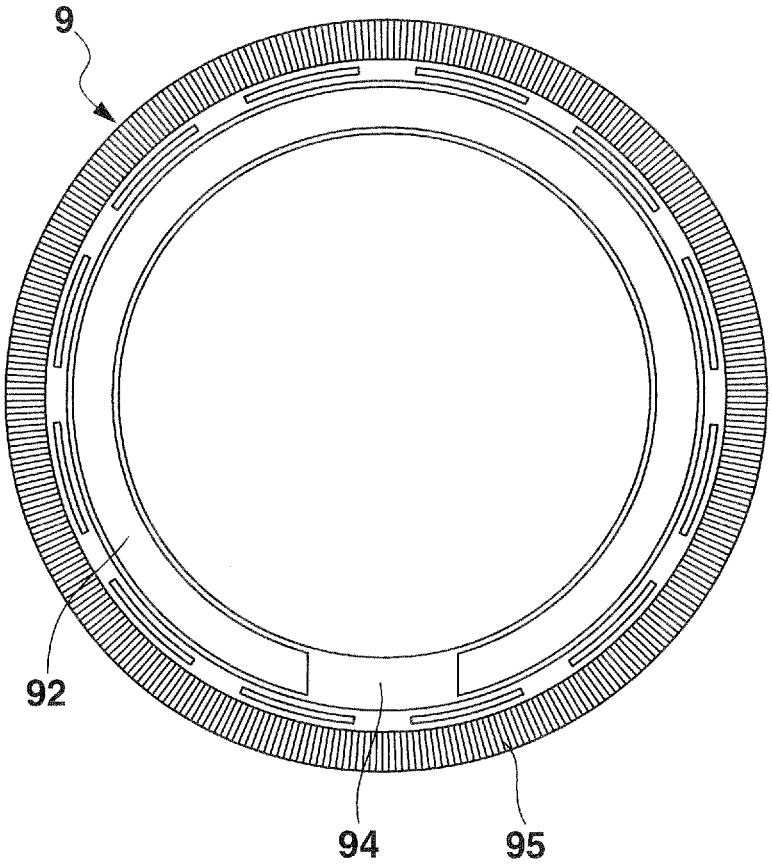
FIG. 15 is a plan view showing the rotating ring in accordance with the second embodiment.

FIG. 15 is a perspective view of the rotating ring 9 viewed from the back side thereof (the side facing the module 4; the back-side cover 3 side of the watch 100).

As shown in FIG. 15, onto the back side of the rotating ring 9, a magnetic sheet 92 is attached along the inner circumference of the rotating ring 9. The magnetic sheet 92 is a magnetic substance formed by processing a magnetic material such as ferrite or a material including magnetic powder into the shape of a sheet.

In the second embodiment, the magnetic sheet 92 is approximately in the shape of "C" formed, for example, by cutting a part of a ring-shaped sheet.

The magnetic sheet 92 shields radio waves which attempt to enter the antenna 5 by absorbing the radio waves with magnetic loss of the magnetic material of the magnetic sheet 92. Of the rotating ring 9, a part where the magnetic sheet 92 is attached is a shielding part which shields radio waves, and a part where the magnetic sheet 92 is not attached (namely, the part where the magnetic sheet 92 is cut) is a penetration part 94 which allows penetration of radio waves.

On the front side of the rotating ring (the visual confirmation side; the side facing the windshield 2 of the watch 100), an information display surface 91 is formed. The information display surface 91 is a slope which slopes down from the windshield 2 side to the back-side cover 3 side as approaching from the outer circumference side of the rotating ring 9 to the inner circumference side thereof. On the information display surface 91, not-shown graduations or the like are formed. The gradations divide the rotating ring 9 equally into 60 parts along the circumferential direction. The rotating ring 9 functions as a timer or the like which counts time elapsed since a predetermined time by the hands pointing the gradations. The gradations or the like formed on the information display surface 91 of the rotating ring 9 are not limited to the gradations or the like described herein. Furthermore, by forming a plurality of kinds of gradations or the like on the information display surface 91, a plurality of pieces of information may be displayed.

Furthermore, at a point on the front side of the rotating ring 9, the point corresponding to the position of the penetration part 94, a sensitivity indicator 93 (shown in FIG. 10) is provided. The sensitivity indicator 93 is formed, for example, by printing, adhesion, deposition, or carving. The sensitivity indicator 93 indicates that the point corresponds to the penetration part 94 which allows penetration of radio waves.

By providing the sensitivity indicator 93, a user can easily confirm the positions of the shielding part and the penetration part 94 from the visual confirmation side of the watch 100, by looking at the sensitivity indicator 93.

As shown in FIG. 15, a rack (gear wheel) 95 is formed on the back side of the rotating ring 9 along the outer circumferential edge of the rotating ring 9 (i.e. along the circumferential direction). Each tooth of the rack 95 projects downward so that the rack 95 is engaged with the above-mentioned ring drive gear wheel 85 disposed on the shaft 81 of the watch stem 8.

Figure 16:
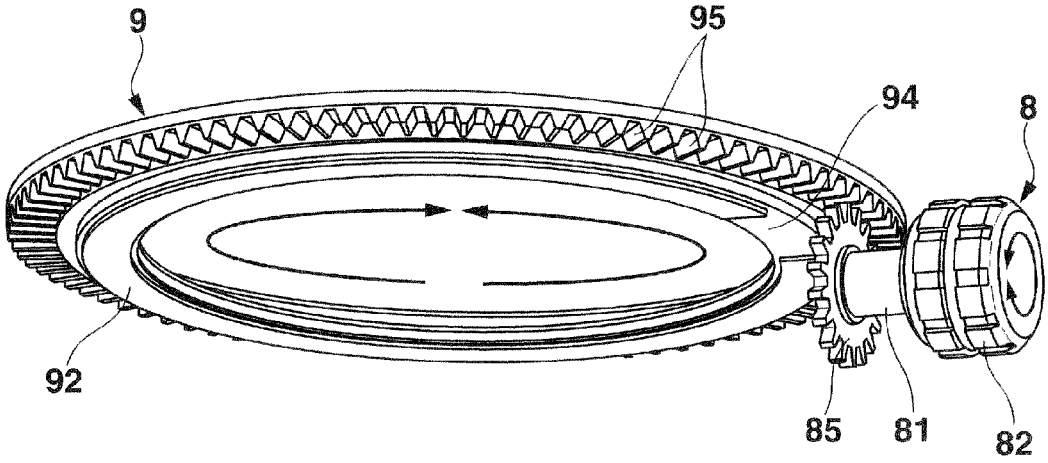
FIG. 16 is a perspective view showing the rotating ring and the watch stem in accordance with the second embodiment.

FIG. 16 is a perspective view showing the rotating ring 9 and the watch stem 8 having the ring drive gear wheel 85 which is engaged with the rotating ring 9.

As shown in FIG. 16, the ring drive gear wheel 85 of the watch stem 8 is connected to the rack 95 of the rotating ring 9 from the lower side so that the rack 95 is engaged with the ring drive gear wheel 85. By rotating the watch stem 8 in a state in which the rack 95 is engaged with the ring drive gear wheel 85, a turning force produced by rotating the watch stem 8, which is the rotation operation section, with the center of the shaft 81 as the rotation center is conveyed to the rotating ring 9 via the ring drive gear wheel 85, thereby rotating the rotating ring 9 in a predetermined direction (clockwise or counterclockwise).

As described above, the rotating ring 9 includes the shielding part, which is the part where the magnetic sheet 92 is attached, and the penetration part 94, which is the part where the magnetic sheet 92 is not attached. When the watch stem 8 as the rotation operation section is operated, and accordingly the rotating ring 9 rotates with its center as the rotation center (namely, along the circumferential direction of the approximately-columnar module 4, in the second embodiment), the positions of the shielding part and the penetration part 94 are changed. Accordingly, the covered area of the antenna 5 covered with the shielding part can be adjusted.

Figure 17:
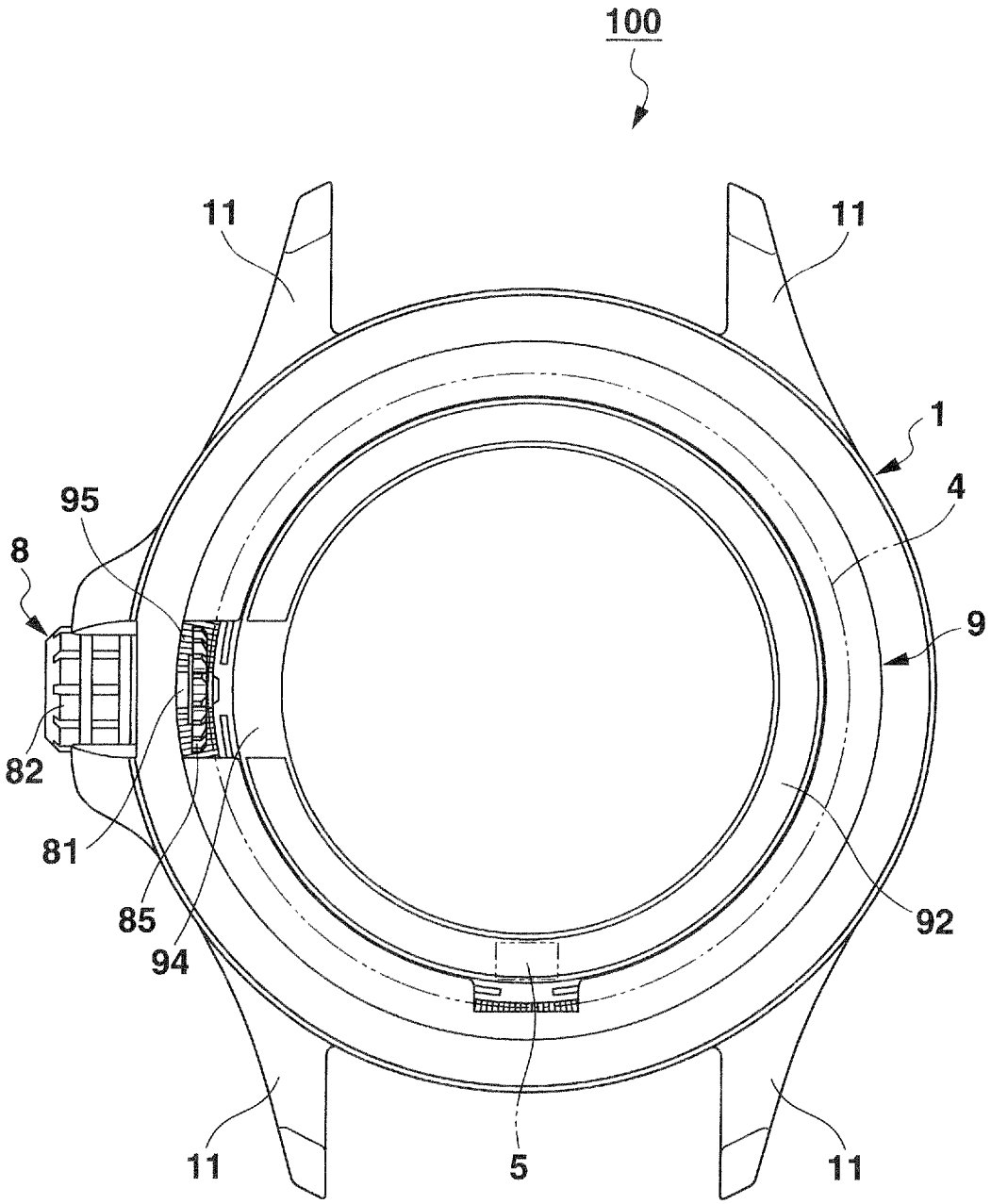
FIG. 17 is a plan view showing a positional relationship between the rotating ring shown in FIG. 15 and the antenna in a state in which the radio wave sensitivity of the antenna is low.
Figure 18:
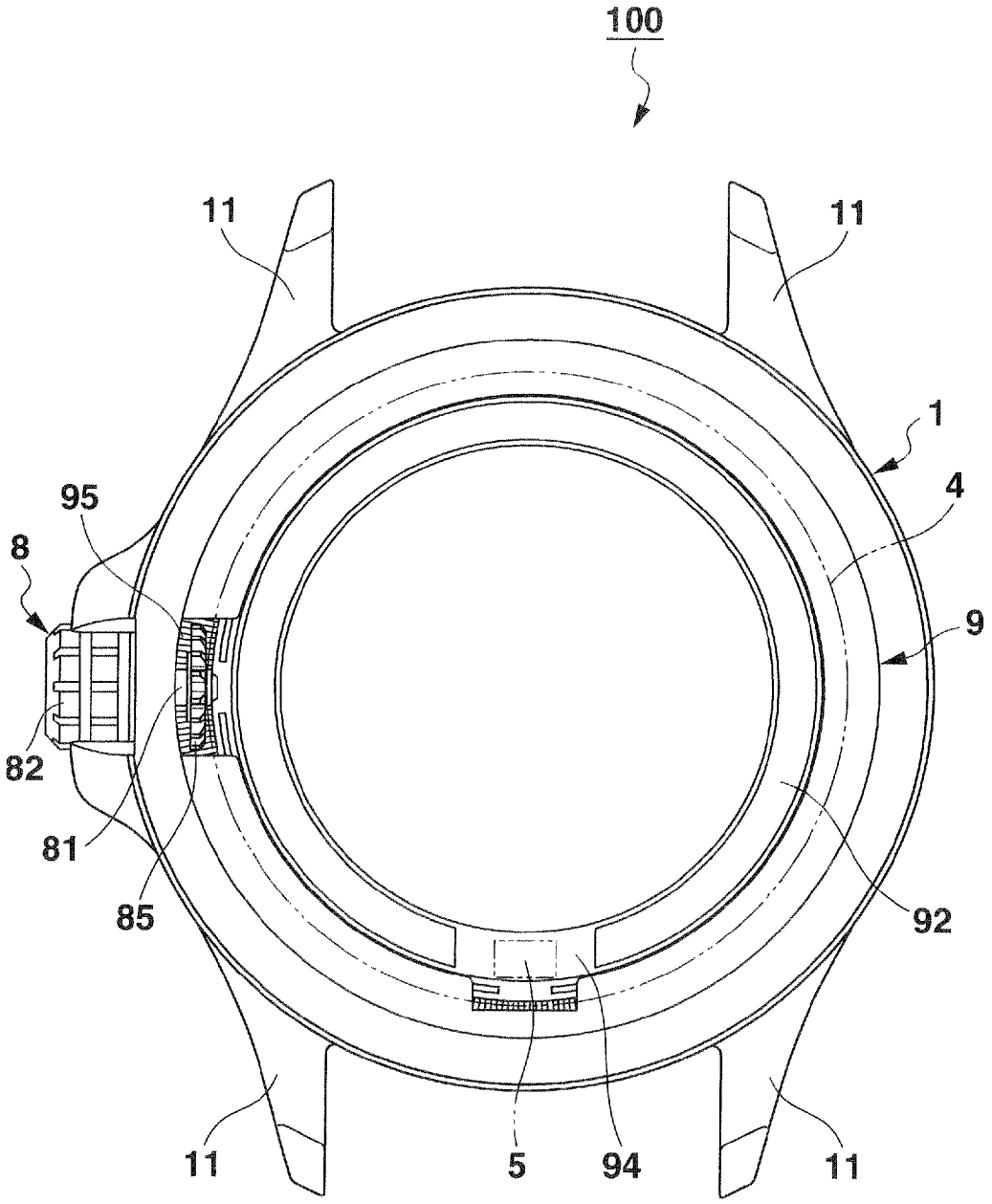
FIG. 18 is a plan view showing a positional relationship between the rotating ring shown in FIG. 15 and the antenna in a state in which the radio wave sensitivity of the antenna is high.

The adjustment of the covered area of the antenna 5 is described, referring to FIGS. 17 and 18. Each of FIGS. 17 and 18 shows the watch 100 viewed from the back side thereof in a state in which the back-side cover 3, the module 4 and the like are removed. The module 4 and the antenna 5 are shown by chain double-dashed lines, respectively.

When the watch stem 8 is operated to rotate the rotating ring 9 in such a way that the shielding part (namely, the part where the magnetic sheet 92 is attached) is disposed over the antenna 5 (namely, over the position for six o'clock of the watch 100), the antenna 5 is covered with the magnetic sheet 92 (namely, the covered area of the antenna 5 becomes wide), as shown in FIG. 17. Consequently, radio waves which attempt to enter the antenna 5 are absorbed by the magnetic sheet 92, and accordingly the radio wave sensitivity of the antenna 5 becomes low.

Furthermore, when the watch stem 8 is operated to rotate the rotating ring 9 in such a way that the penetration part 94 (namely, the part where the magnetic sheet 92 is not attached) is disposed over the antenna 5 (namely, over the position for six o'clock of the watch 100), the antenna 5 is not covered with the magnetic sheet 92 (namely, no covered area of the antenna exists), as shown in FIG. 18. Consequently, radio waves which attempt to enter the antenna 5 can easily enter the antenna 5, and accordingly the radio wave sensitivity of the antenna 5 becomes high.

In the second embodiment, the module 7 holding the antenna 5, the rotating ring 9 disposed over the module 4 in such a way as to cover the antenna 5, and the watch stem 8 as the rotation operation section which rotates the rotating ring 9 constitute the sensitivity adjustment device 101 which adjusts the radio wave sensitivity of the antenna 5.

Next, operations of the sensitivity adjustment device 101 and the watch 100 as a radio wave communication device in, the second embodiment are described.

In the second embodiment, the watch 100 can adjust the radio wave sensitivity of the antenna 5 by adjusting the covered area of the antenna 5, with the sensitivity adjustment device 101.

That is, the watch 100 has a plurality of communication modes (in the second embodiment, the pairing mode, the data synchronization mode and the terminal search mode/losing prevention mode) executable under different radio wave sensitivity of the antenna 5, and the sensitivity adjustment device 101 adjusts the covered area of the antenna 5 in such a way that the radio wave sensitivity of the antenna 5 becomes suitable for each communication mode.

The communication modes are not limited thereto. For example, the present invention may have only one of the pairing mode, the data synchronization mode and the terminal search mode/losing prevention mode, or may have communication modes in addition to these three communication modes.

The pairing mode is a communication mode, for example, used by a user of the watch 100 to establish pairing (namely, to perform the initial registration operation to associate terminal devices with each other) between the watch 100 and a terminal device (a terminal device of a friend of the user, for example) so that the watch 100 can transmit/receive data to/from the terminal device. For example, in order to establish pairing between the watch 100 and a terminal device which is a mobile phone of the user's friend, the watch 100 transmits a query signal to the terminal device. When the terminal device transmits an answer signal for the query signal to the watch 100, and the antenna 5 of the watch 100 receives the answer signal and transmits the signal to the control section, the pairing is established between the watch 100 and the terminal device.

When communications are carried out in the pairing mode, in order not to establish unexpected pairing with a terminal device which exists around the watch 100 but is not a party for the pairing, it is preferable to adjust the radio wave sensitivity of the antenna 5 to be low to the extent that only when the watch 100 and a terminal device contact with each other or come close enough to almost contact with each other, transmission/reception of radio waves between the watch 100 and the terminal, device is available.

Hence, in the second embodiment, when an instruction to select the pairing mode is inputted with the input operation section or the like, and communications are carried out in the pairing mode, the rotating ring 9 is rotated in such a way that the shielding part, namely, the part where the magnetic sheet 2 is attached, of the rotating ring 9 is disposed over the antenna 5, whereby the radio wave sensitivity of the antenna 5 is adjusted to be low.

More specifically, a user rotates the watch stem 8 to rotate the rotating ring 9 to a point where the sensitivity indicator 93 provided to correspond to the penetration part 94 is disposed at a position other than the position for six o'clock of the watch 100, whereby the shielding part (the part where the magnetic sheet 92 is attached) is adjusted to cover the antenna 5 (namely, at the position for six o'clock of the watch 100) (shown in FIG. 17).

In this state, when a user makes a terminal device which is a party for the pairing contact with the watch 100 or places the terminal device close to the watch 100, namely, within a distance of about 10 cm from the watch 100, a query signal for pairing (for example, a signal including an individual identification number or the like of the watch 100) is transmitted from the antenna 5 of the watch 100, and only a terminal device located within a distance in which the query signal can be received receives the query signal. The terminal device which receives the query signal returns an answer signal (for example, a signal including an individual identification number or the like of the terminal device) to the watch 100. When receiving the answer signal, the antenna 5 of the watch 100 transmits the answer signal to the control section of the watch 100. Then, the control section registers the terminal device as a terminal device which can transmit/receive data to/from the watch 100 thereafter. Thus, pairing (initial registration operation between terminal devices) is completed.

It is preferable that a user is informed about establishment of pairing and/or failure of pairing by a message displayed with the hands, the liquid crystal display section or the like on the dial plate 6, flashing of a not-shown light, an alarm sound or the like.

Furthermore, in a case where pairing is not established between the watch 100 and a terminal device which is a party for the pairing (namely, in a case where a message or the like indicating failure of the pairing is displayed) in a state in which the radio wave sensitivity of the antenna 5 is low (namely, in a state in which the antenna 5 is covered with the magnetic sheet 92), pairing may be tried again. For that, a user rotates the watch stem 8 to rotate the rotating ring 9 to a point where the sensitivity indicator 93 is disposed at the position for six o'clock of the watch 100, whereby the penetration part 94 (the part where the magnetic sheet 92 is not attached) is adjusted to cover the antenna 5. Then, pairing is tried again.

The data synchronization mode is a communication mode, for example, used by a user of the watch 100 to synchronize data thereof with data of a terminal device or the like which already establishes pairing with the watch 100 and is located relatively close to the watch 100 (for example, within a distance of about 1 m to 2 m from the antenna 5), for example, a terminal device which a user of the watch 100 wears (a not-shown mobile phone or the like which the user carries).

The terminal search mode is a communication mode, for example, used by a user of the watch 100 to search for a terminal device of the user or a friend of the user, the terminal device which already establishes pairing with the watch 100. The losing prevention mode is a communication mode, for example, used by a user of the watch 100 to be given a warning by a buzzer sound or the like when the user is a predetermined distance (for example, about 5 m) or more away from a terminal device of the user, the terminal device which already establishes pairing with the watch 100.

Communications in these modes are communications between the watch 100 and a terminal device which already establishes pairing with the watch 100. Hence, there is no possibility that communications are established between the watch 100 and an unexpected terminal device.

Hence, in the second embodiment, when an instruction to select the data synchronization mode or the terminal search mode/losing prevention mode is inputted with the input operation section or the like, and communications are carried out in the mode, the rotating ring 9 is rotated in such a way that the penetration part 94, namely, the part where the magnetic sheet 92 is not attached, of the rotating ring 9 is disposed over the antenna 5, whereby the radio wave sensitivity of the antenna 5 is adjusted to be high.

More specifically, a user rotates the watch stem 8 to rotate the rotating ring 9 to a point where the sensitivity indicator 93 provided to correspond to the penetration part 94 is disposed at the position for six o'clock of the watch 100, whereby the penetration part 94 (the part where the magnetic sheet 92 not attached) is adjusted to cover the antenna 5 (shown in FIG. 18).

Accordingly, the antenna 5 of the watch 100 can transmit/receive radio waves to/from a terminal device located a little away from the watch 100. For example, in the data synchronization mode, the watch 100 transmits/receives data to/from a mobile phone or the like which a user of the watch 100 wears, to synchronize its data with the data of the mobile phone or the like. Furthermore, in the terminal search mode, a query signal is transmitted from the antenna 5 of the watch 100 to a terminal device which already establishes pairing with the watch 100 and is located within a distance of about 5 m from the watch 100, the query signal which requires the terminal device to answer. When the terminal device receives the query signal, and transmits an answer signal to the watch 100, a user of the watch 100 is informed about that by a buzzer sound, flashing of a light or the like. Still further, in the losing prevention mode, a query signal is transmitted from the antenna 5 of the watch 100 to a terminal device which already establishes pairing with the watch 100, the query signal which requires the terminal device to answer. The terminal device receives the query signal, and transmits an answer signal to the watch 100. When not receiving the answer signal from the terminal device, the control section of the watch 100 judges that the terminal device is a predetermined distance (in the second embodiment, 5 m, within which the antenna 5 can transmit/receive radio waves) or more away from the watch 100, and informs the user about that by a buzzer sound, flashing of a light or the like.

As described above, according to the second embodiment, a plurality of communication modes (the pairing mode, the data synchronization mode and the terminal search mode/losing prevention mode, for example) can be used under different radio wave sensitivity of the antenna 5. Accordingly, various communications can be carried out in accordance with a user's purpose or use of the watch 100.

The watch 100 in the second embodiment has a mechanical configuration as a method for adjusting the radio wave sensitivity of the antenna 5 to be suitable for the communication modes. That is, the watch 100 adjusts the radio wave sensitivity of the antenna 5 by rotating the rotating ring 9 so as to adjust the covered area of the antenna 5 covered with the shielding part. Consequently, as compared with a case where the radio wave sensitivity is changed in a communication-related module such as a reception circuit, the watch 100 can reduce the electric power consumption for adjusting the radio wave sensitivity of the antenna 5.

Furthermore, a watch is expected to be small and have a light weight (miniaturized). Hence, it is difficult to secure a space to accommodate a large battery. However, the watch 100 in the second embodiment includes the sensitivity adjustment device 101 which includes: the module 4 holding the antenna 5; the rotating ring 9 disposed above the module 4 in such a way as to cover the antenna 5; and the watch stem 8 as the rotation operation section which rotates the rotating ring 9, and can adjust the radio wave sensitivity of the antenna 5 with a mechanical configuration. Consequently, as compared with the case where the radio wave sensitivity is changed in a communication-related module, the watch 100 can reduce the electric power consumption. Furthermore, because the electric power consumption can be reduced, it becomes unnecessary that the watch 100 accommodates a large battery or the like. Accordingly, miniaturization of a device can be achieved.

Furthermore, the radio wave sensitivity of the antenna 5 can be adjusted by rotating the rotating ring 9 which has the shielding part and the penetration part 94. Accordingly, the radio wave sensitivity of the antenna 5 can be adjusted to be suitable for the communication modes without an additional component to adjust the radio wave sensitivity thereof, and hence simplification of a configuration of a device and miniaturization of a device can be achieved.

Furthermore, the shielding part is formed by attaching the magnetic sheet 92, which is the magnetic substance, to the back side of the rotating ring 9. Accordingly, an existing standardized rotating ring can be easily diverted into the rotating ring 9, and hence manufacturing costs of the rotating ring 9 and the watch 100 by extension can be reduced.

In the second embodiment, the magnetic sheet 92 as the magnetic substance is disposed approximately in the shape of "C". However, the shape and disposition of the magnetic sheet 92 is not limited thereto.

Figure 19:
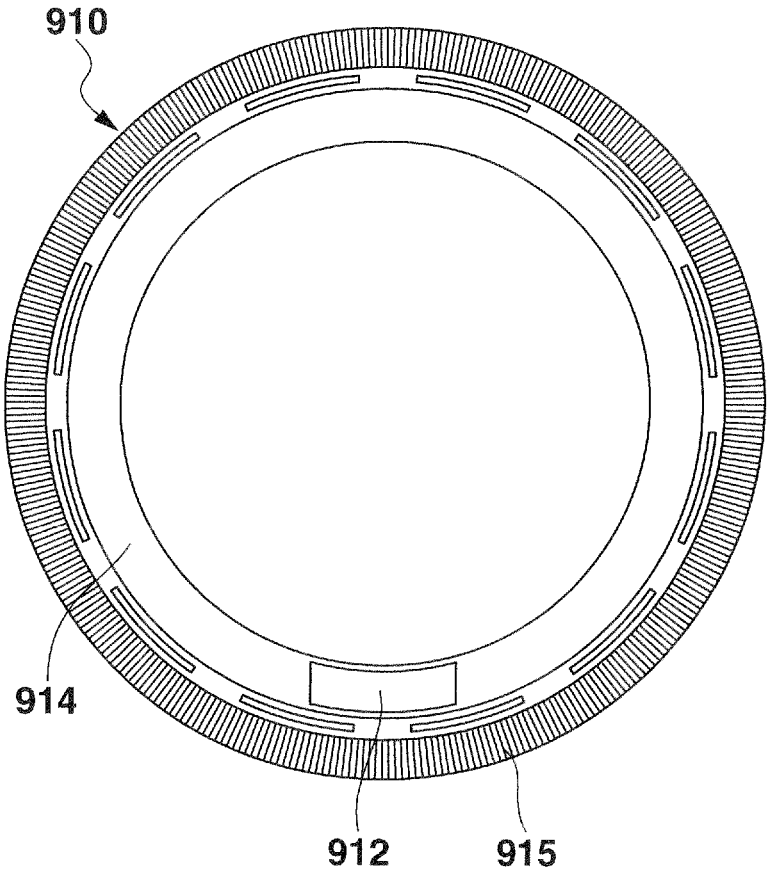
FIG. 19 is a plan view showing a rotating ring in accordance with a modification of the second embodiment.

For example, as shown in FIG. 19, only onto a part of the back side of a rotating ring 910 including a rack 915, a magnetic sheet 912 having the size with which the antenna 5 can be covered may be attached. In this case, the part where the magnetic sheet 912 is attached is the shielding part, and the rest is a penetration part 914.

Figure 20:
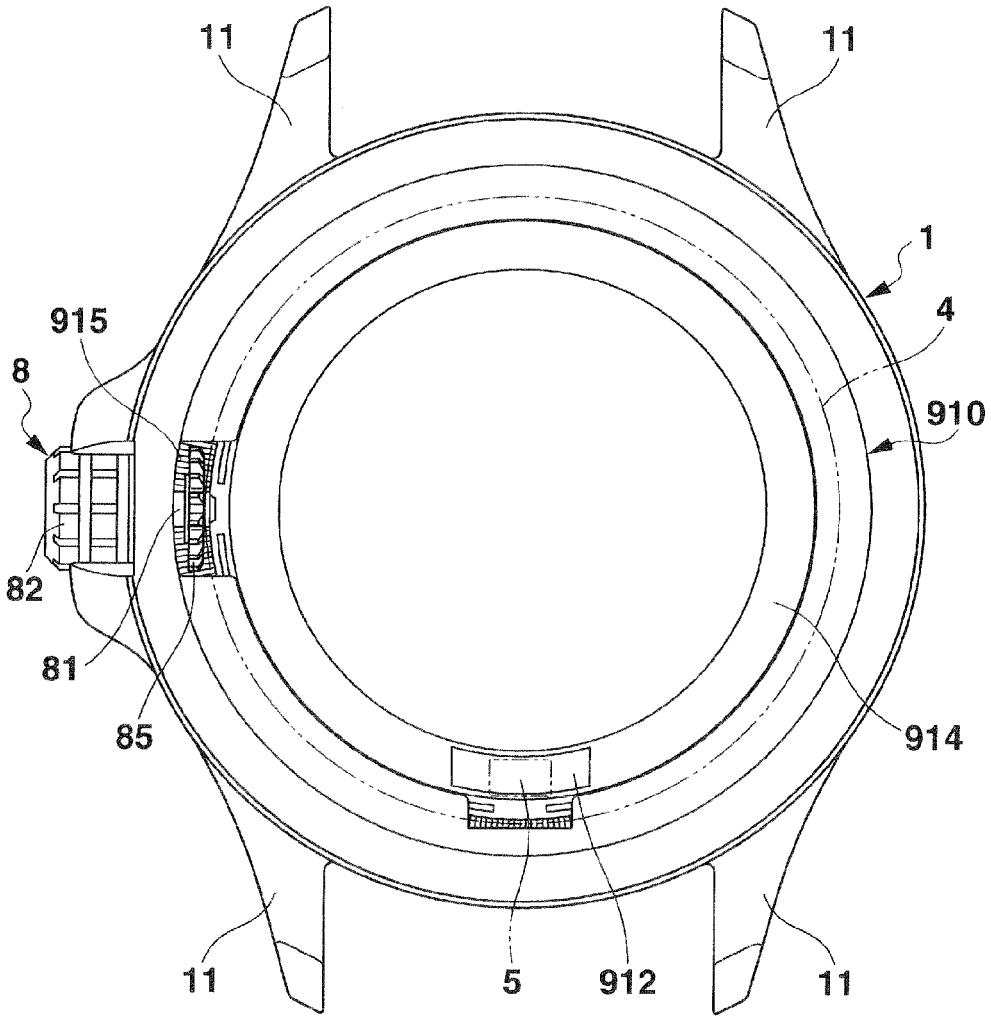
FIG. 20 is a plan view showing a positional relationship between the rotating ring shown in FIG. 19 and the antenna in a state in which the radio wave sensitivity of the antenna is low.
Figure 21:
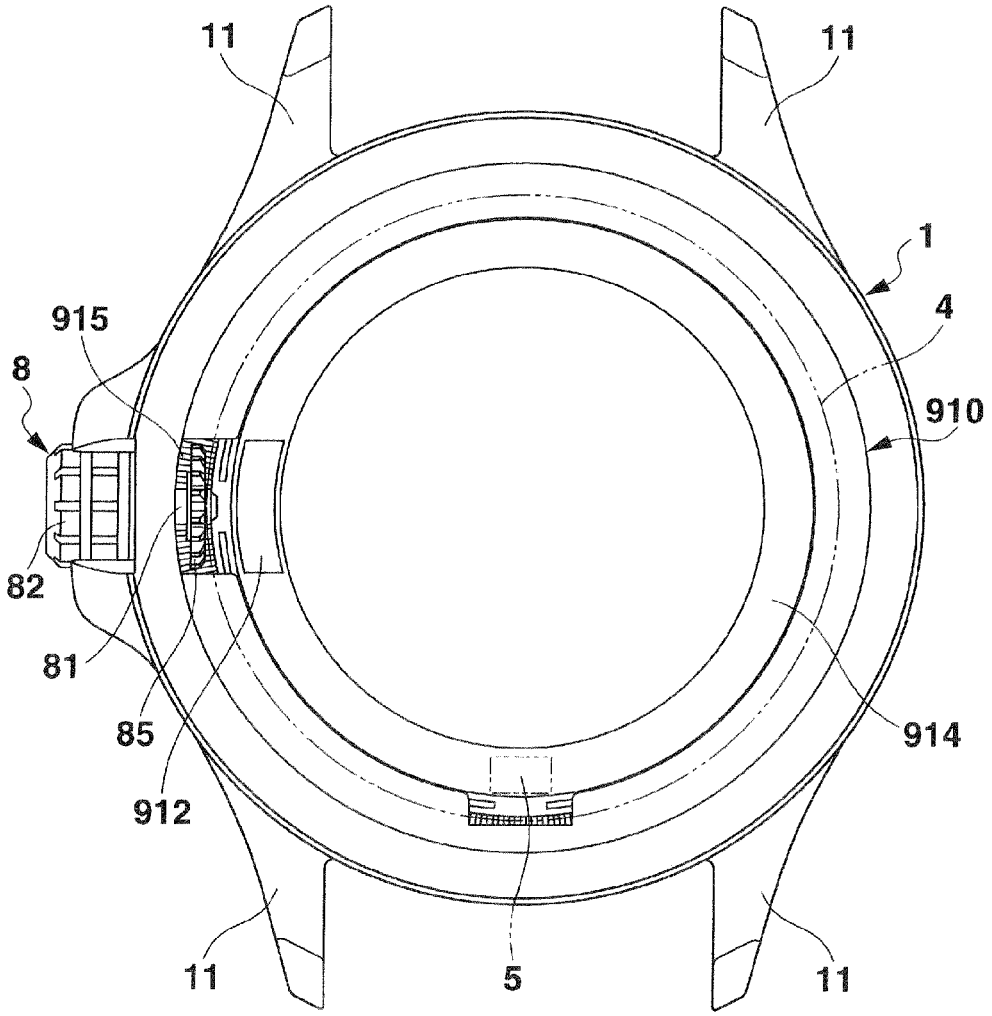
FIG. 21 is a plan view showing a positional relationship between the rotating ring shown in FIG. 19 and the antenna in a state in which the radio wave sensitivity of the antenna is high.

Therefore, when pairing is performed (namely, the pairing mode is set), as shown in FIG. 20, the rotating ring 910 is rotated to a point where the part where the magnetic sheet 912 is attached covers the antenna 5. Accordingly, the radio wave sensitivity of the antenna 5 can be decreased to be suitable for the pairing mode. When pairing is not established between terminal devices in the state shown in FIG. 20, or when data of terminal devices which already establish pairing with each other are synchronized (namely, the data synchronization mode is et), or when a terminal device (the watch 100) searches for a terminal device which already establishes pairing with the watch 100 (namely, the terminal search mode/losing prevention mode is set), as shown in FIG. 21, the rotating ring 910 is rotated to a point where the part where the magnetic sheet 912 is not attached covers the antenna 5. Accordingly, the radio wave sensitivity of the antenna 5 can be increased, to the extent that even terminal devices which are apart from each other can transmit/receive radio waves with each other.

Furthermore, in the second embodiment, the magnetic sheet 92 attached to the rotating ring 9 is the magnetic substance. However, the magnetic substance is not limited to being sheet-shaped. For example, the magnetic substance may be embedded in a part of the rotating ring 9 so as to form the shielding part.

Furthermore, in the second embodiment, of the rotating ring 9, the part where the magnetic sheet 92 as the magnetic substance is attached is the shielding part, and the part where the magnetic sheet 92 is not attached is the penetration part 94. However, the configurations of the shielding part and the penetration part are not limited thereto.

Figure 22:
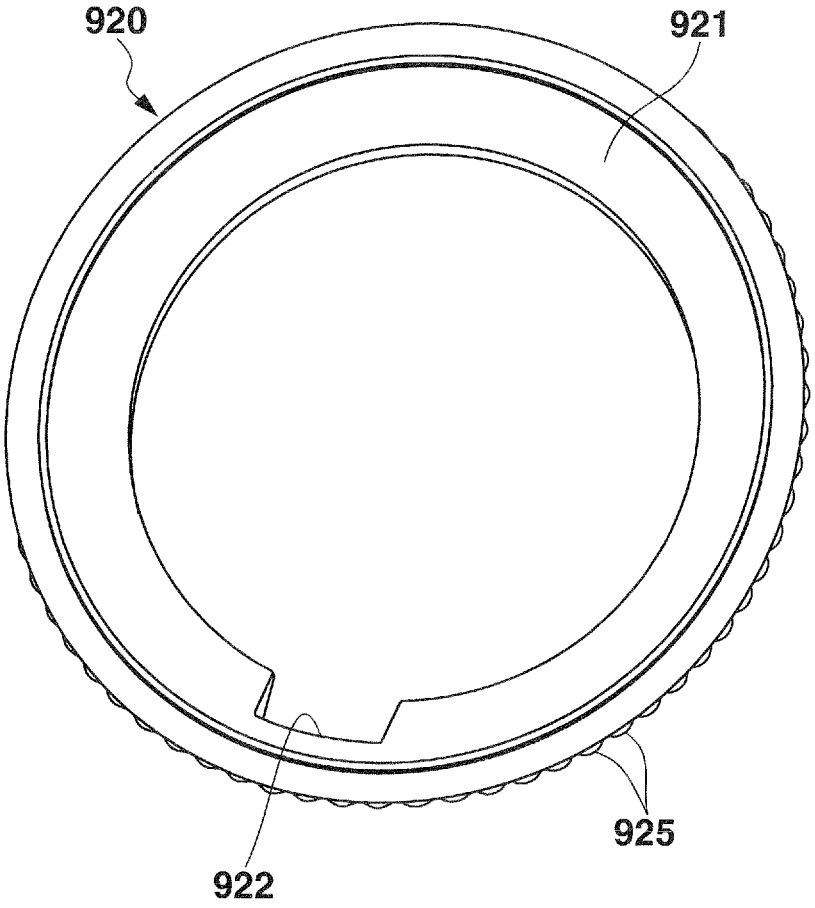
FIG. 22 is a perspective view of a rotating ring in accordance with another modification of the second embodiment.

For example, as shown in FIG. 22, a rotating ring 920 itself, which includes a rack 925 on the back side thereof, may be made of a radio wave shielding material which shields radio waves, and have a notch 92 made at a part of the rotating ring 920. The radio wave shielding material is a material which shields radio waves, such as a radio wave absorber which absorbs radio waves. More specifically, for example, the rotating ring 920 is formed by casting a magnetic material or a material including magnetic powder to be a predetermined shape or by attaching a magnetic sheet to a base material casted to be a predetermined shape. In this case, the notch 922 is the penetration part, and the rest is a shielding part 921.

Figure 23:
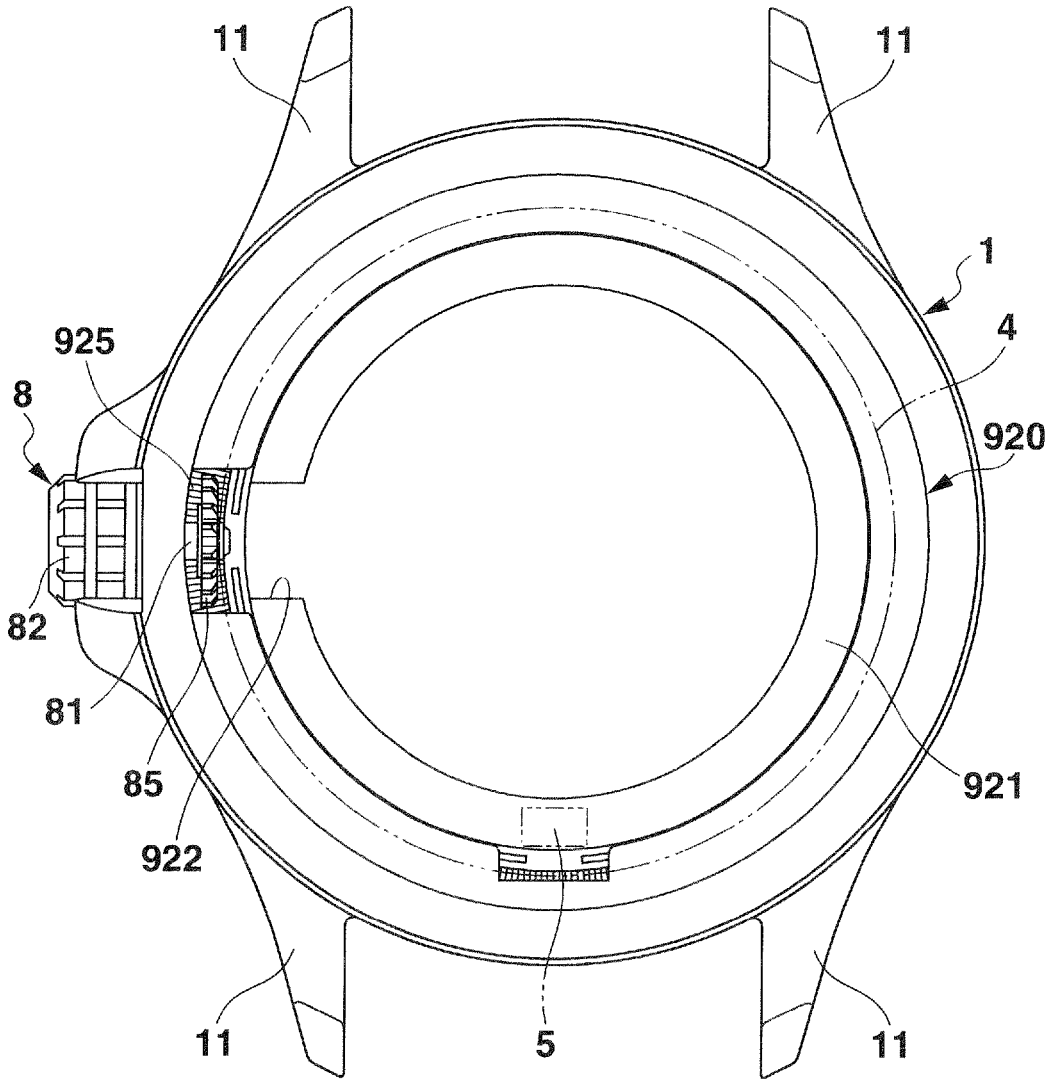
FIG. 23 is a plan view showing a positional relationship between the rotating ring shown in FIG. 22 and the antenna in a state in which the radio wave sensitivity of the antenna is low.
Figure 24:
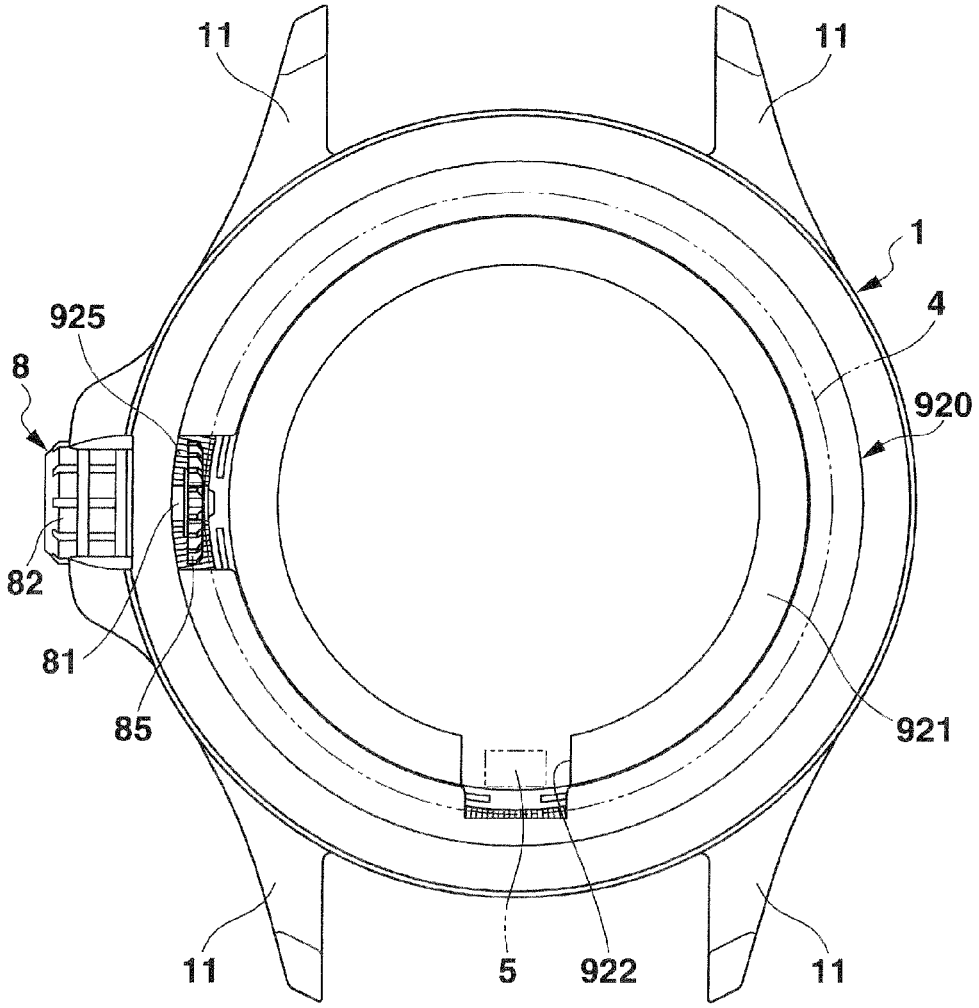
FIG. 24 is a plan view showing a positional relationship between the rotating ring shown in FIG. 22 and the antenna in a state in which the radio wave sensitivity of the antenna is high.

Therefore, when pairing is performed, as shown in FIG. 23, the rotating ring 910 is rotated to a point where the part other than the notch 922 covers the antenna 5. Accordingly, the radio wave sensitivity of the antenna 5 can be decreased to be suitable for the pairing mode. When pairing is not established between terminal devices in the state shown in FIG. 23, or when data of terminal devices which already establish pairing with each other are synchronized, or when a terminal device (the watch 100) searches for a terminal device which already establishes pairing with the watch 100, as shown in FIG. 24, the rotating ring 910 is rotated to a point where the notch 922 covers the antenna 5. Accordingly, the radio wave sensitivity of the antenna 5 can be increased to the extent that even terminal devices which are apart from each other can transmit/receive radio waves with each other.

The penetration part provided in the rotating ring 910 is not limited to the notch 922. For example, it is possible that a hole is made in a part of the rotating ring 920, and the hole functions as the penetration part.

Even when the rotating ring 920 itself is made of a radio wave shielding material which shields radio waves, and the notch 922 or the hole functions as the penetration part and the rest functions as the shielding part, the radio wave sensitivity of the antenna 5 can be adjusted by a mechanical configuration. Furthermore, a large battery or the like is not needed for adjusting the radio wave sensitivity of the antenna 5. Accordingly, miniaturization of a device can be achieved.

Figure 25:
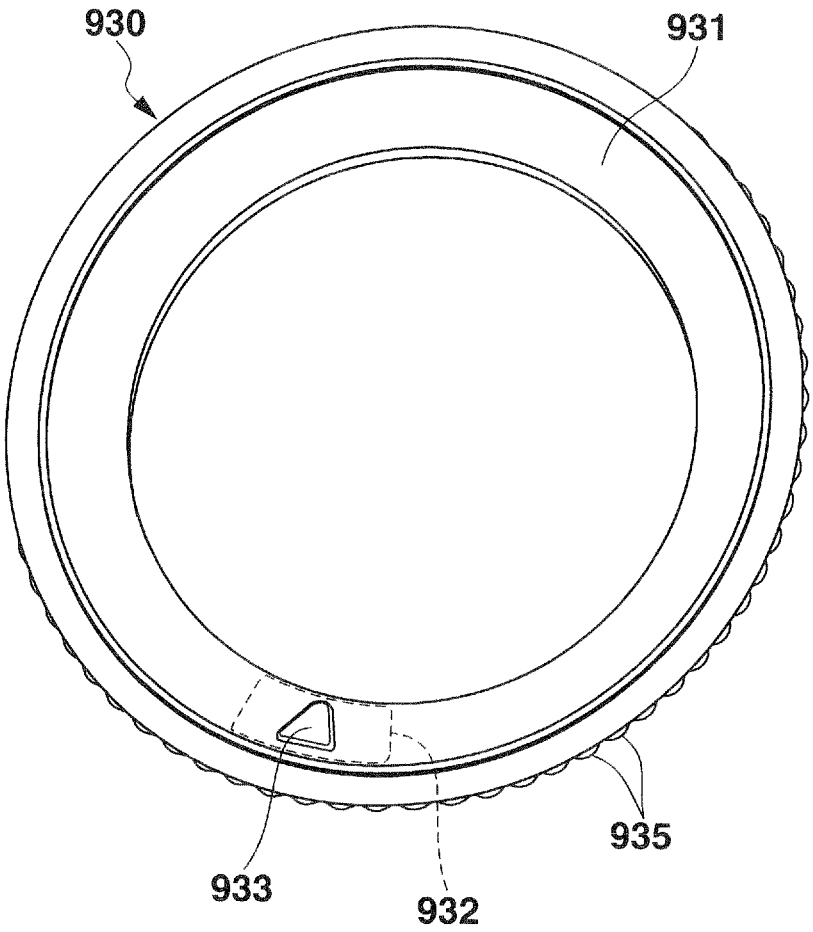
FIG. 25 is a perspective view of a rotating ring in accordance with another modification of the second embodiment.

Furthermore, as shown in FIG. 25, a part of a rotating ring 93 including a rack 935 on the back side thereof may be formed to be thicker than the rest as a thick part 932 where penetration of radio waves is difficult as compared with the rest. In this case, the thick part 932 is the shielding part, and the rest is a penetration part 931. It is preferable to add a sensitivity indicator 933 at a point on the front side of the rotating ring 93, the point corresponding to the position of the thick part 932. The sensitivity indicator 933 indicates the position of the thick part 932, namely, the shielding part.

Even when the thick part 932 is the shielding part and the rest is the penetration part 931, the radio wave sensitivity of the antenna 5 can be adjusted by a mechanical configuration. Furthermore, a large battery or the like is not needed for adjusting the radio wave sensitivity of the antenna 5. Accordingly, miniaturization of a device can be achieved.

In the second embodiment, radio waves are shielded by disposing/attaching a magnetic substance onto a part so as to make the shielding part, and absorbing the radio waves with the magnetic loss of the magnetic material of the magnetic substance. However, as long as the shielding part shields radio waves, the configuration of the shielding part is not limited to absorbing radio waves with the magnetic loss.

Furthermore, in the second embodiment, the watch 100 is an analog watch having hands. However, the watch 100 is not limited thereto. For example, the watch 100 may be a digital watch having a liquid crystal display section constituted of a liquid crystal panel or the like, or may be a watch having hands and a liquid crystal display section.

Furthermore, in the second embodiment, the watch stem 8 is operated to rotate the rotating ring 9. However, the configuration to rotate the rotating ring 9 is not limited thereto. For example, in addition to the watch stem 8, an operation member (a rotation operation section) to rotate the rotating ring 9 may be provided.

Furthermore, in the second embodiment, as a function of the watch stem 8, only the function to rotate the rotating ring 9 is described. However, functions of the watch stem 8 are not limited thereto.

For example, the watch stem 8 may have a plurality of levels for which the watch stem 8 is pulled, and be engaged with a different gear wheel disposed in the case 1 in accordance with the level(s) for which the watch stem 8 is pulled, to be able to perform various operations in addition to rotating the rotating ring 9. In this case, for example, in a state in which the watch stem 8 is pulled for one level, a gear wheel disposed on the watch stem 8 is connected to the rotating ring 9, and when the watch stem 8 is rotated, the rotating ring 9 rotates, whereby the radio wave sensitivity of the antenna 5 is adjusted; in a state in which the watch stem 8 is pulled for two levels, the gear wheel disposed on the watch stem 8 is connected to a part of a gear train in the module 4, the gear train which rotates a minute hand, and when the watch stem 8 is rotated, a turning force produced thereby is conveyed to the gear train, which rotates the minute hand, whereby the position of the minute hand is adjusted, and time is adjusted accordingly; and in a state in which the watch stem 8 is pulled for three levels, the gear wheel disposed on the watch stem 8 is connected to a date wheel in the module 4, and when the watch stem 8 is rotated, the date wheel rotates, whereby date is adjusted.

[Third Embodiment]

In the following, referring to FIGS. 26 to 34, a sensitivity adjustment device and a watch including the sensitivity adjustment device in accordance with a third embodiment of the present invention is described.

Figure 26:
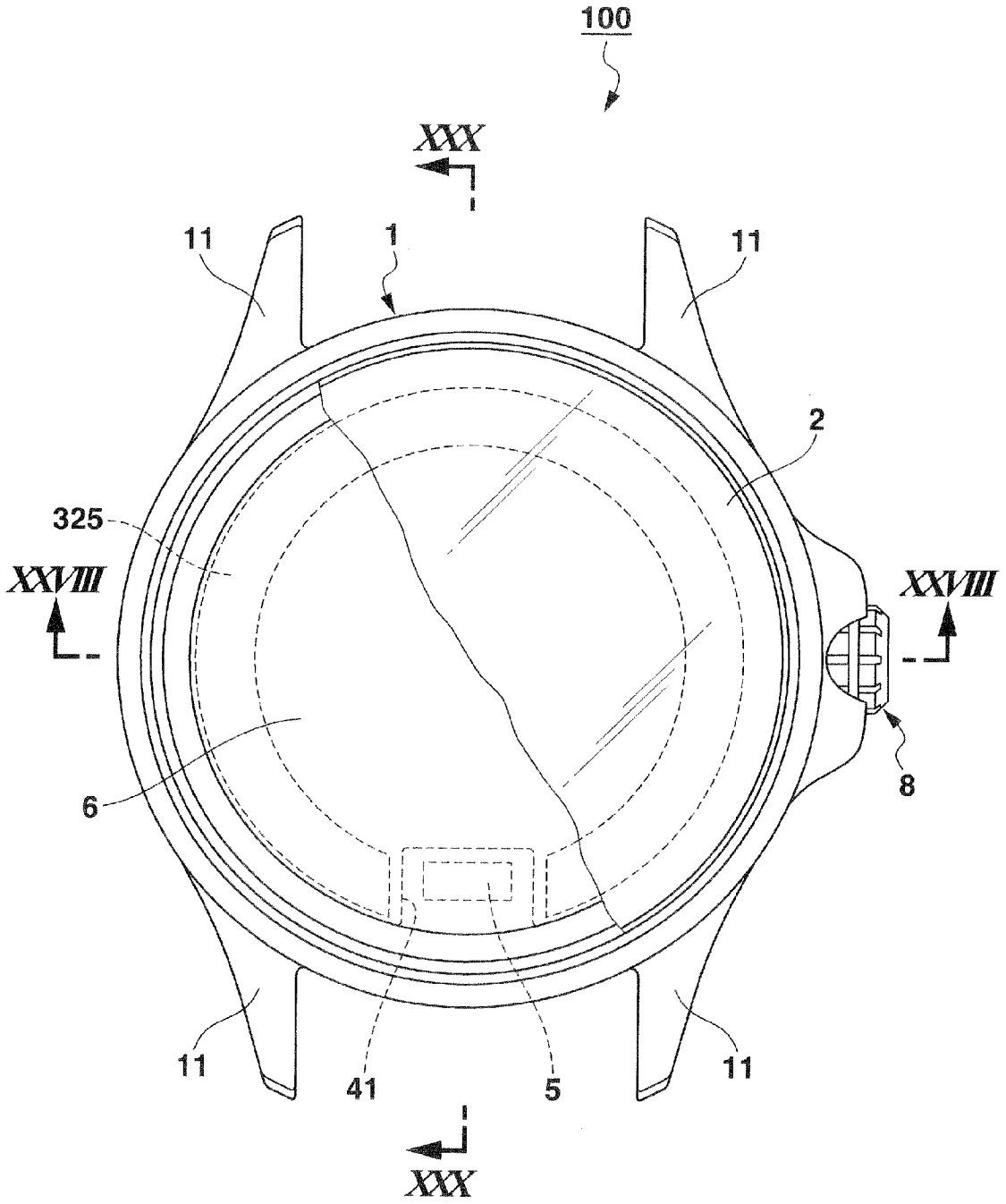
FIG. 26 is a front view of a watch to which a sensitivity adjustment device in accordance with a third embodiment of the present invention is applied.
Figure 27:
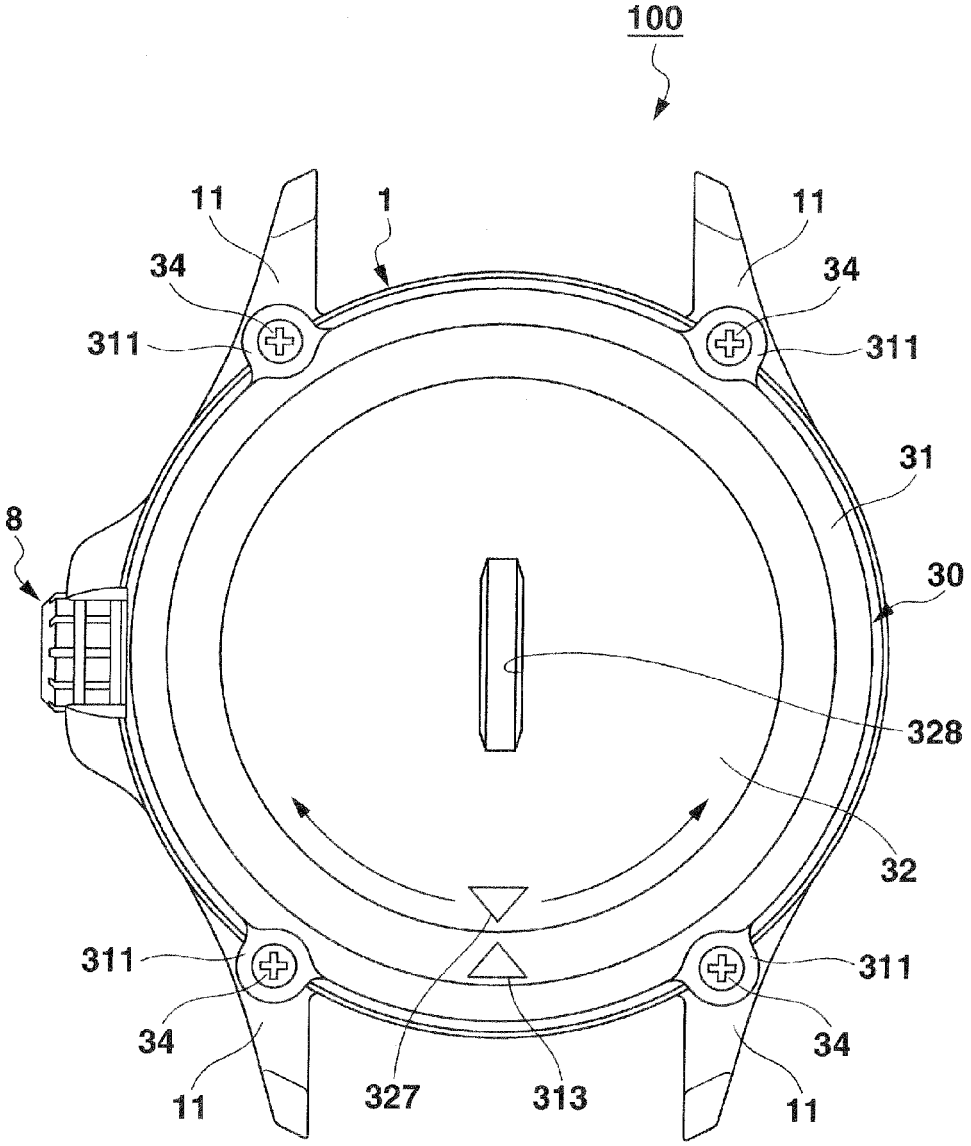
FIG. 27 is a plan view of the watch shown in FIG. 26 viewed from the back side thereof.
Figure 28:
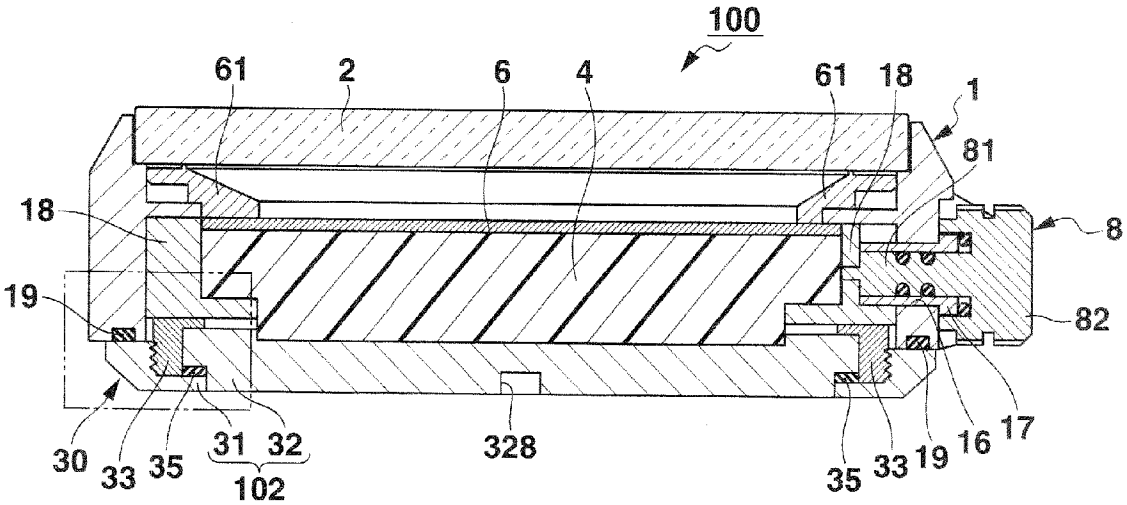
FIG. 28 is a sectional view of the watch taken along the line XXVIII-XXVIII of FIG. 26.
Figure 29:
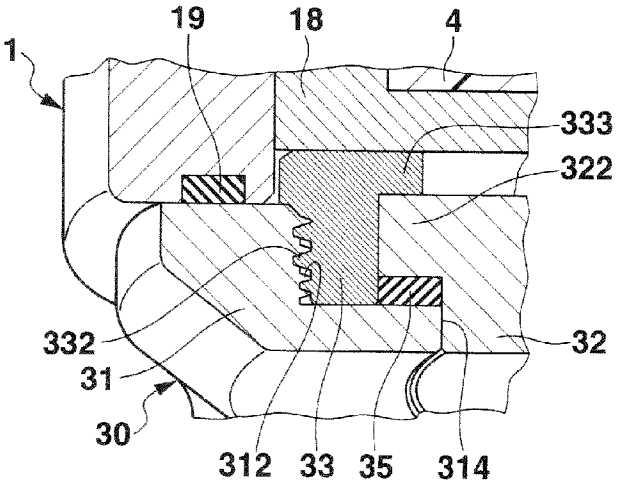
FIG. 29 is a main-part sectional view of a dashed line part in FIG. 28 being enlarged.
Figure 30:
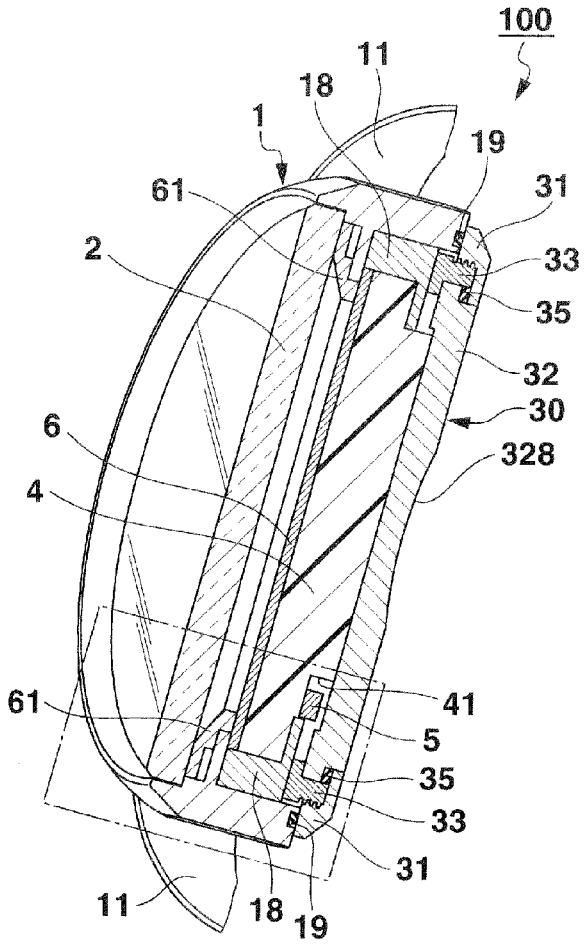
FIG. 30 is a sectional view of the watch taken along the line XXX-XXX of FIG. 26.
Figure 31:
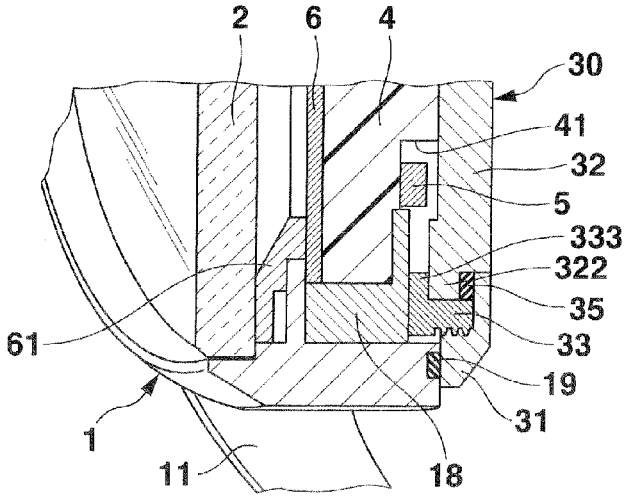
FIG. 31 is a main-part sectional view of a dashed line part in FIG. 30 being enlarged.

FIG. 26 is a plan view of a watch in accordance with the third embodiment, a part of the watch being notched (cut). FIG. 27 shows the watch shown in FIG. 26 viewed from the back side thereof. FIG. 28 is a sectional view of the watch taken along the line XXVIII-XXVIII of FIG. 26. FIG. 29 is an enlarged view of a dashed line part in FIG. 28. FIG. 30 is a sectional view of the watch taken along the line XXX-XXX of FIG. 26. FIG. 31 is an enlarged view of a dashed line part in FIG. 30.

A watch 100 in the third embodiment rotates not-shown hands (a second hand, a minute hand and an hour hand) by electric drive so as to display time. In FIGS. 26 to 31, the hands and the like are not shown.

As shown in FIGS. 26, 28 and the like, the watch 100 includes a case 1 formed in the shape of a short column, the inside of which is hollow. In the third embodiment, the case 1 is made of, for example, a metallic material such as stainless or titanium. It is not necessary that the case 1 is made of a metallic material, and hence the case 1 may be made of resin or the like.

Strap attachment parts 11 where a watchstrap (not shown) is attached are formed at the upper and lower ends of the case 1 (the upper and lower ends in FIG. 6), namely, at the twelve o'clock and six o'clock direction side ends of the watch 100.

On the lateral surface of the case 1, a through hole 16 (shown in FIG. 28) which passes through the case 1 is made. In the third embodiment, the through hole 16 is made at a point on the lateral surface of the case 1, the point corresponding to the position for three o'clock of the watch 100. However, this is not a limit. For example, the through hole 16 may be made at a point on the surface of the case 1, the point corresponding to the position for nine o'clock or four o'clock of the watch 100.

As shown in FIG. 28, a tube-shaped member 17 is inserted into the through hole 16 from the outside of the case 1 to the inside thereof. On the side where the through hole 16 is made on the lateral surface of the case 1, a watch stem 8 is provided. The watch stem 8 includes a shaft 81 and a watch stem top 82. The shaft 81 is inserted into the through hole 16 via the tube-shaped member 17, so as to pass through the case 1 from the outside to the inside thereof. The watch stem top 82 is formed on an end side of the shaft 81, and has the diameter larger than the inner diameter of the tube-shaped member 17.

At the insertion start part of the shaft 81, a not-shown gear wheel is provided. The gear wheel is connected to, for example, a part of a gear train which rotates a hand such as a minute hand (not shown) disposed in a module 4 (described below). When the watch stem 8 is rotated, a turning force is conveyed to the gear train which rotates the hand, so as to adjust the position of the hand, and accordingly to adjust time.

The module 4 which is formed to be approximately columnar is disposed in the case 1. The shape of the module 4 is not limited to being columnar. The module 4 is formed in such a way that a not-shown timepiece movement (for example, a driving motor, a gear train mechanism, or the like), a not-shown circuit substrate having various electronic components thereon, and the like are housed in a not-shown, housing made of resin or the like. The timepiece movement moves the not-shown hands of the watch 100.

The module 4 is supported by a stand frame member 18 from the back side of the watch 100 (the lower side in FIG. 28).

As shown in FIGS. 30 and 31, in the third embodiment, at a point on the circumferential part of the lower side of the module 4 (the back side of the watch 100), the point corresponding to the position for six o'clock of the watch 100 (a position at the lower side in FIG. 26), a concave part 41 is formed, and a small chip or loop antenna 5 is disposed in the concave part 32.

The antenna 5 is held on the module 4, for example, by being fixed with an adhesive agent or the like. It is not necessary to form the concave part 41 on the module 4, and hence the antenna 5 may be disposed on a plane surface. The antenna 5 may be attached to the surface of the module 4, or embedded in the module 4. The position where the antenna 5 is disposed is not limited to the positions described herein, and hence may be another position.

The antenna 5 wirelessly transmits/receives signals to/from an external device in accordance with a standard such as Bluetooth®. The communication standard and the communicable frequency band of the antenna 5 are not limited to Bluetooth®, and hence appropriately selected so as to be suitable for each communication (namely, suitable for the frequency or the like of each communication) carried out by the watch 100. In addition, as long as the antenna 5 is small, its type and shape are not particularly limited. Furthermore, as described below, in the third embodiment, an antenna having the maximum radio wave sensitivity with which transmission/reception of signals to/from a device located within a distance of about 5 m from the antenna is available is used as the antenna 5. However, the radio wave sensitivity of the antenna 5 is not limited thereto, and hence an antenna having the maximum radio wave sensitivity with which transmission/reception of signals to/from a device located further is available may be used as the antenna 5.

The antenna 5 is electrically connected with a circuit substrate via a riot-shown connector, and connected with a not-shown transmission/reception control circuit via the connector.

In the third embodiment, the antenna 5 and the not-shown transmission/reception control circuit themselves always maintain the maximum radio wave sensitivity (for example, the radio wave sensitivity with which transmission/reception of radio waves are available within a distance of about 5 m from the antenna 5, in the third embodiment), and the radio wave sensitivity of the antenna 5 is mechanically adjusted by changing a covered area of the antenna 5 covered with a sensitivity adjustment device 102 (shown in FIG. 28).

A dial plate 6 is disposed on the upper side of the module 4 in the case 1 (the upper side in FIG. 28; the visual confirmation side of the watch 100). On the upper side of the module 4, for example, a liquid crystal display section which displays numbers, letters and the like by a digital system may be disposed in addition to the analog-system dial plate 6.

On the dial plate 6, namely, over the module 4, a partition 61 is provided in such a way as to be rotatable with its center as the rotation center.

The case 1 includes a front-side opening part on the front side (the upper side in FIGS. 28 and 29) and a back-side opening part on the back side thereof (the lower side in FIGS. 28 and 29). A windshield 2 made of a transparent material, such as glass, is fitted to the front-side opening part to cover/close the front-side opening part via a not-shown waterproof ring or the like.

A back-side cover 30 as a cover is fitted to the back-side opening part to cover/close the back-side opening part via a waterproof ring 19.

Referring to FIGS. 27 to 33, the back-side cover 30 of the watch 100 in the third embodiment is described in detail.

In the third embodiment, the back-side cover 30 includes a back-side cover main body 31, a rotating cover 32 and a fixing ring 33.

In the third embodiment, among the components of the back-side cover 30, the back-side cover main body 31 and the fixing ring 33 are made of a metallic material such as stainless or titanium, and the rotating cover 32 is made of resin such as industrial plastic or engineering plastic (for example, polyacetal (POM), polyamide (PA), polycarbonate (PC) or the like). However, the materials of the back-side cover main body 31, the rotating cover 32 and the fixing ring 33 are not limited thereto. For example, the back-side cover main body 31 and the fixing ring 33 may be made of not a metallic material but resin or the like, and the rotating cover 32 may be made of a material other than the materials described herein.

Figure 32:
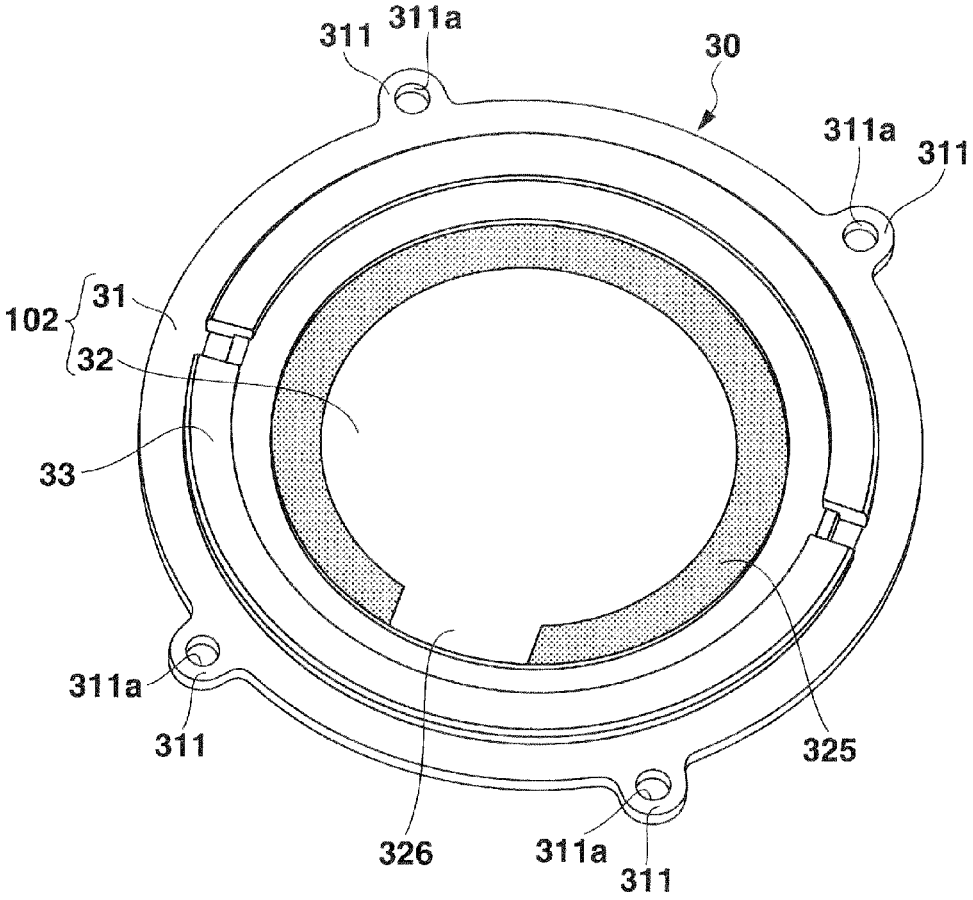
FIG. 32 is a perspective view of a rotating cover in accordance with the third embodiment.

As shown in FIGS. 27, 28, 32 and the like, the back-side cover main body 31 is a ring-shaped member, the approximate center of which is open, and fitted to the back-side opening part of the case 1. The back-side cover main body 31 is provided with fixing parts at four points along its outer circumference. In each of the fixing parts, a screw hole 311*a* is made. The back-side cover 30 is fitted to the case 1 by fixing the fixing parts 311 of the back-side cover main body 31 to the case 1 with screws 34. The configuration to fit the back-side cover 30 to the case 1 is not limited thereto.

On the inner circumferential surface of the back-side cover main body 31, a main-body-side screw groove 312 is formed. The main-body-side screw groove 312 and a ring-side screw groove 332 of the fixing ring 33 described below are screwed together.

Furthermore, in the third embodiment, at a point (namely, the position for six o'clock of the watch 100) on the back side of the back-side cover main body 31 (namely, the side being the outer side when the back-side cover 30 is fitted to the case 1), the point corresponding to the position of the antenna 5, an antenna indicator 313 which indicates the position of the antenna 5 is provided, for example, by printing, adhesion, deposition or carving.

The rotating cover 32 which is approximately disc-shaped is disposed on the back-side cover main body 31 via a waterproof ring 35 in such a way as to cover an opening part 314 and to be rotatable.

The rotating cover 32 is formed to have the outer diameter almost equal to the inner diameter of the opening part 314 of the back-side cover main body 31. The rotating cover 32 is fitted into the opening part 314 of the back-side cover main body 31 from the front side of the back-side cover main body 31 (the upper side in FIG. 28) to cover/close the opening part 314 thereof with almost no gap therebetween.

On the outer circumference of the front side of the rotating cover 32 (namely, the side being the inner side when the back-side cover 30 is fitted to the case 1), a sword guard part 322 having the outer diameter larger than the inner diameter of the opening part 314 thereof is disposed. When the rotating cover 32 is fitted into the opening part 314 of the back-side cover main body 31, the sword guard part 322 is fixed to the inner side of the back-side cover main body 31.

The rotating cover 32 is made of a material which allows penetration of radio waves, such as resin, and disposed in such a way that a part of the rotating cover 32 covers the antenna held on the module 4. The material of the rotating cover 32 is not limited to resin.

FIG. 32 is a plan view of the rotating cover 32 viewed from the front side (the side being the inner side when the back-side cover 30 is fitted to the case 1).

As shown in FIG. 32, onto the front side of the rotating cover 32, a magnetic sheet 325 is attached (disposed) along the circumferential direction of the rotating cover 32. The magnetic sheet 325 is a magnetic substance formed by processing a magnetic material such as ferrite or a material including magnetic powder into the shape of a sheet.

In the third embodiment, the magnetic sheet 325 is approximately in the shape of "C" formed, for example, by cutting a part of a ring-shaped sheet.

The magnetic sheet 325 shields radio waves which attempt to enter the antenna 5 by absorbing the radio waves with magnetic loss of the magnetic material of the magnetic sheet 325. Of the rotating cover 32, a part where the magnetic sheet 325 is attached is a shielding part which shields radio waves, and a part where the magnetic sheet 325 is not attached (namely, the part where the magnetic sheet 325 is cut) is a penetration part 326 which allows penetration of radio waves.

Furthermore, as shown in FIG. 27, at a point on the back side of the rotating cover 32 (the side being the outer side when the back-side cover 30 is fitted to the case 1), the point corresponding to the position of the penetration part 326, a sensitivity indicator 327 is provided. The sensitivity indicator 327 is formed, for example, by printing, adhesion, deposition, or carving. The sensitivity indicator 327 indicates that the point corresponds to the penetration part 326 which allows penetration of radio waves. The point where the sensitivity indicator 327 is provided is not limited to the point corresponding to the position of the penetration part 326. For example, the sensitivity indicator 327 may be disposed to be symmetrical to the penetration part 326 at a point (namely, the center of the disc-shaped rotating cover 32).

By providing the sensitivity indicator 327, a user can easily confirm the positions of the shielding part (namely, the part where the magnetic sheet 325 is attached) and the penetration part 326 from the visual confirmation side of the watch 100, by looking at the sensitivity indicator 327.

Furthermore, in the third embodiment, as described above, on the back side of the back-side cover main body 31, the antenna indicator 313 which indicates the position of the antenna 5 is provided. Accordingly, the penetration part 326 can be easily adjusted to the position of the antenna 5 by matching the sensitivity indicator 327 with the antenna indicator 313.

As shown in FIGS. 27 and 30, at the approximate center of the back side of the rotating cover 32 (namely, the side being the outer side when the back-side cover 30 is fitted to the case 1), a concave part 328, which is formed to be thin, long, and groove-shaped, is provided. The concave part 328 is formed to be the deepest at its center in a longer direction, and approximately arc-shaped in a sectional view. As long as the tip of a user's nail or a coin can be inserted, the size, depth, shape and the like of the concave part 328 are not particularly limited.

The rotating cover 32 can be rotated to an optional point clockwise or counterclockwise by inserting the tip of a nail or a coin into the concave part 328 and rotating the concave part 328 in either direction shown by an arrow in FIG. 27. By rotating the rotating cover 32, the positions of the shielding part (the part where the magnetic sheet 325 is attached) and the penetration part 326 are changed, so that the covered area of the antenna 5 covered with the shielding part is adjusted. Accordingly, the radio wave sensitivity of the antenna 5 can be adjusted.

The fixing ring 33 is a ring-shaped member having the rotating-ring-side screw groove 332 on the outer circumferential surface thereof.

At an end side of the fixing ring 33, a projecting part 333 which almost horizontally projects toward the center of the fixing ring 33 is formed. The projecting part 333 may be provided along the whole circumference of the fixing ring 33, or partially provided along the inner circumference of the fixing ring 33, namely, at some points.

The fixing ring 33 is installed between the outer circumferential surface of the rotating cover 32 and the inner circumferential surface of the back-side cover main body 31 after the rotating cover 32 is fitted to the back-side cover main body 31, whereby the rotating cover 32 is fixed to the back-side cover main body 31, so as not to fall off from the back-side cover main body 31.

More specifically, by screwing the rotating-ring-side screw groove 332 of the fixing ring 33 and the main-body-side screw groove 312 of the back-side cover main body 31 together, the projecting part 333 of the fixing ring 33 fixes the sword guard part 322 of the rotating cover 32 from above (the upper side in FIGS. 28 and 29). Consequently, the sword guard part 322 of the rotating cover 32 is pressed onto the waterproof ring 35, so that air-tightness of the back-side cover 30 is secured, and the rotating cover 32 is fitted to the back-side cover main body 31 in such a way as to be rotatable.

As described above, the rotating cover 32 includes the shielding part, which is the part where the magnetic sheet 325 is attached, and the penetration part 326, which is the part where the magnetic sheet 325 is not attached. When the rotating cover 32 is rotated along the circumferential direction of the case 1 by a user's operation, the positions of the shielding part and the penetration part 326 are changed. Accordingly, the covered area of the antenna 5 covered with the shielding part can be adjusted.

Figure 33:
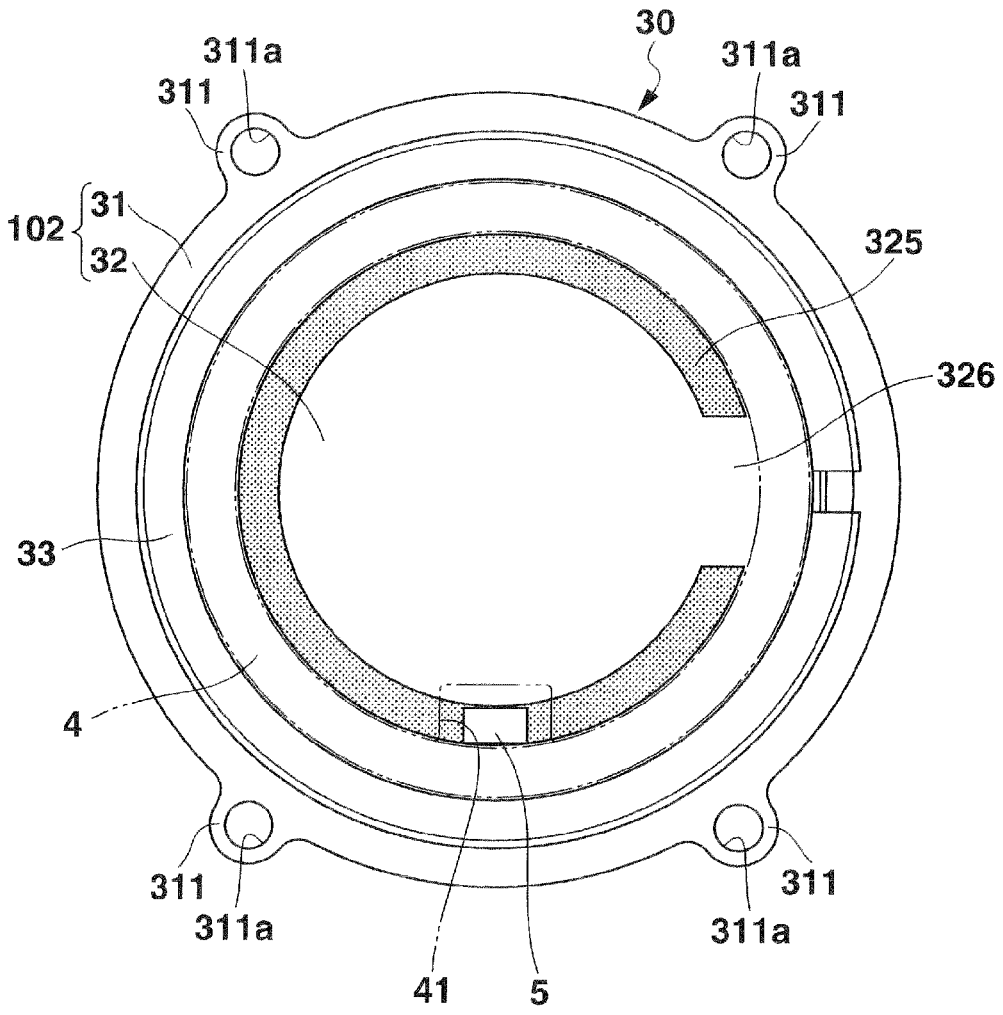
FIG. 33 is a plan view showing a positional relationship between the rotating cover shown in FIG. 32 and an antenna in a state in which the radio wave sensitivity of the antenna is low.
Figure 34:
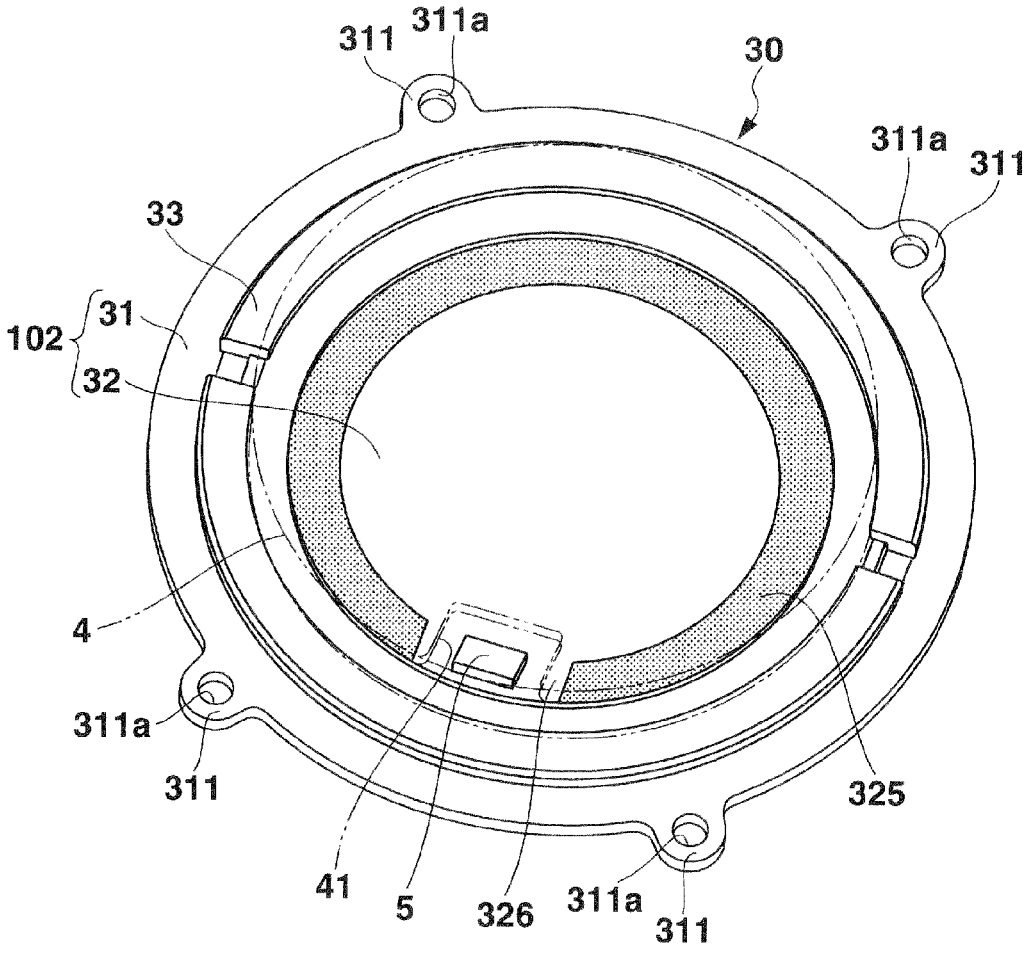
FIG. 34 is a plan view showing a positional relationship between the rotating cover shown in FIG. 32 and the antenna in a state in which the radio wave sensitivity of the antenna is high.

The adjustment of the covered area of the antenna 5 is described, referring to FIGS. 33 and 34. Each of FIGS. 33 and 34 shows disposition of the antenna 5 fixed to the module 4 and the rotating cover 32 from the front side of the watch 100 (the upper side in FIG. 28). The module 4 and the antenna 5 are shown by chain double-dashed lines, respectively.

When by a user's operation, as shown in FIG. 33, the rotating cover 32 is rotated in such a way that the shielding part (namely, the part where the magnetic sheet 325 is attached) is disposed over the antenna 5 (namely, over the position for six o'clock of the watch 100), the antenna 5 is covered with the magnetic sheet 325 (namely, the covered area of the antenna 5 becomes wide). Consequently, radio waves which attempt to enter the antenna 5 are absorbed by the magnetic sheet 325, and accordingly the radio wave sensitivity of the antenna 5 becomes low.

Furthermore, when by a user's operation, as shown in FIG. 34, the rotating cover 32 is rotated in such a way that the penetration part 326 (namely, the part where the magnetic sheet 325 is not attached) is disposed over the antenna 5 (namely, over the position for six o'clock of the watch 100), the antenna 5 is not covered with the magnetic sheet 325 (namely, no covered area of the antenna 5 exists). Consequently, radio waves which attempt to enter the antenna 5 can easily enter the antenna 5, and accordingly the radio wave sensitivity of the antenna 5 becomes high.

In the third embodiment, the back-side cover main body 31 of the back-side cover 30 which covers/closes the opening part of the case 1 and the rotating cover 32 fitted to the back-side cover main body 31 so as to be rotatable constitute the sensitivity adjustment device 102 which adjusts the radio wave sensitivity of the antenna 5.

The watch 100 also includes: for example, a control section including an input operation section which switches various modes or the like, a CPU (Central Processing Unit), a ROM (Read Only Memory), and a RAM (Random Access Memory); a transmission/reception control circuit which controls transmission/reception of radio waves; a timer circuit which performs time correction and the like; an oscillation circuit; and a hand drive circuit which drives the hands. These are the same as those provided for a common watch, and hence the illustrations and description thereof are omitted.

Next, operations of the sensitivity adjustment device 102 and the watch 100 as a radio wave communication device in the third embodiment are described.

In the third embodiment, the watch 100 can adjust the radio wave sensitivity of the antenna 5 by adjusting the covered area of the antenna 5, with the sensitivity adjustment device 102.

That is, the watch 100 has a plurality of communication modes (in the third embodiment, the pairing mode, the data synchronization mode and the terminal search mode/losing prevention mode) executable under different radio wave sensitivity of the antenna 5, and the sensitivity adjustment device 102 adjusts the covered area of the antenna 5 in such a way that the radio wave sensitivity of the antenna 5 becomes suitable for each communication mode.

The communication modes are not limited thereto. For example, the present invention may have only one of the pairing mode, the data synchronization mode and the terminal search mode/losing prevention mode, or may have communication modes in addition to these three communication modes.

The pairing mode is a communication mode, for example, used by a user of the watch 100 to establish pairing (namely, to perform the initial registration operation to associate terminal devices with each other) between the watch 100 and a terminal device (a terminal device of a friend of the user, for example) so that the watch 100 can transmit/receive data to/from the terminal device. For example, in order to establish pairing between the watch 100 and a terminal device which is a mobile phone of the user's friend, the watch 100 transmits a query signal to the terminal device. When the terminal device transmits an answer signal for the query signal to the watch 100, and the antenna 5 of the watch 100 receives the answer signal and transmits the signal to the control section, the pairing is established between the watch 100 and the terminal device.

When communications are carried out in the pairing mode, in order not to establish unexpected pairing with a terminal device which exists around the watch 100 but is not a party for the pairing, it is preferable to adjust the radio wave sensitivity of the antenna 5 to be low to the extent that only when the watch 100 and a terminal device contact with each other or come close enough to almost contact with each other, transmission/reception of radio waves between the watch 100 and the terminal device is available.

Hence, in the third embodiment, when an instruction to select the pairing mode is inputted with the input operation section or the like, and communications are carried out in the pairing mode, the rotating cover 32 is rotated in such a way that the shielding part, namely, the part where the magnetic sheet 325 is attached, of the rotating cover 32 is disposed over the antenna 5, whereby the radio wave sensitivity of the antenna 5 is adjusted to be low.

More specifically, a user inserts his/her nail, a coin or the like into the concave part 328 to rotates the rotating cover 32 to a point where the sensitivity indicator 327 provided to correspond to the penetration part 326 is disposed at a position other than the position for six o'clock of the watch 100, whereby the shielding part (the part where the magnetic sheet 325 is attached) is adjusted to cover the antenna 5 (namely, at the position for six o'clock of the watch 100) (shown in FIG. 33).

In this state, when a user makes a terminal device which is a party for the pairing contact with the watch 100 or places the terminal device close to the watch 100, namely, within a distance of about 10 cm from the watch 100, a query signal for pairing (for example, a signal including an individual identification number or the like of the watch 100) is transmitted from the antenna 5 of the watch 100, and only a terminal device located within a distance in which the query signal can be received receives the query signal. The terminal device which receives the query signal returns an answer signal (for example, a signal including an individual identification number or the like of the terminal device) to the watch 100. When receiving the answer signal, the antenna 5 of the watch 100 transmits the answer signal to the control section of the watch 100. Then, the control section registers the terminal device as a terminal device which can transmit/receive data to/from the watch 100 thereafter. Thus, pairing (initial registration operation between terminal devices) is completed.

It is preferable that a user is informed about establishment of pairing and/or failure of pairing by a message displayed with the hands, the liquid crystal display section or the like on the dial plate 6, flashing of a not-shown light, an alarm sound or the like.

Furthermore, in a case where pairing is not established between the watch 100 and a terminal device which is a party for the pairing (namely, in a case where a message or the like indicating failure of the pairing is displayed) in a state in which the radio wave sensitivity of the antenna 5 is low (namely, in a state in which the antenna 5 is covered with the magnetic sheet 325), pairing may be tried again. For that, a user inserts his/her nail, a coin or the like into the concave part 328 to rotate the rotating cover 32 to a point where the sensitivity indicator 327 is disposed at the position for six o'clock of the watch 100, whereby the penetration part 326 (the part where the magnetic sheet 325 is not attached) is adjusted to cover the antenna 5. Then, pairing is tried again.

The data synchronization mode is a communication mode, for example, used by a user of the watch 100 to synchronize data thereof with data of a terminal device or the like which already establishes pairing with the watch 100 and is located relatively close to the watch 100 (for example, within a distance of about 1 m to 2 m from the antenna 5), for example, a terminal device which a user of the watch 100 wears (a not-shown mobile phone or the like which the user carries).

The terminal search mode is a communication mode, for example, used by a user of the watch 100 to search for a terminal device of the user or a friend of the user, the terminal device which already establishes pairing with the watch 100. The losing prevention mode is a communication mode, for example, used by a user of the watch 100 to be given a warning by a buzzer sound or the like when the user is a predetermined distance (for example, about 5 m) or more away from a terminal device of the user, the terminal device which already establishes pairing with the watch 100.

Communications in these modes are communications between the watch 100 and a terminal device which already establishes pairing with the watch 100. Hence, there is no possibility that communications are established between the watch 100 and an unexpected terminal device.

Hence, in the third embodiment, when an instruction to select the data synchronization mode or the terminal search mode/losing prevention mode is inputted with the input operation section or the like, and communications are carried out in the mode, the rotating cover 32 is rotated in such a way that the penetration part 326, namely, the part where the magnetic sheet 325 is not attached, of the rotating cover 32 is disposed over the antenna 5, whereby the radio wave sensitivity of the antenna 5 is adjusted to be high.

More specifically, a user inserts his/her nail, a coin or the like into the concave part 328 of the rotating cover 32 to rotate the rotating cover 32 to a point where the sensitivity indicator 327 provided to correspond to the penetration part 326 is disposed at the position for six o'clock of the watch 100, whereby the penetration part 326 (the part where the magnetic sheet 325 is not attached) is adjusted to cover the antenna 5 (shown in FIG. 34).

Accordingly, the antenna 5 of the watch 100 can transmit/receive radio waves to/from a terminal device located a little away from the watch 100. For example, in the data synchronization mode, the watch 100 transmits/receives data to/from a mobile phone or the like which a user of the watch 100 wears, to synchronize its data with the data of the mobile phone or the like. Furthermore, in the terminal search mode, a query signal is transmitted from the antenna 5 of the watch 100 to a terminal device which already establishes pairing with the watch 100 and is located within a distance of about 5 m from the watch 100, the query signal which requires the terminal device to answer. When the terminal device receives the query signal, and transmits an answer signal to the watch 100, a user of the watch 100 is informed about that by a buzzer sound, flashing of a light or the like. Still further, in the losing prevention mode, a query signal is transmitted from the antenna 5 of the watch 100 to a terminal device which already establishes pairing with the watch 100, the query signal which requires the terminal device to answer. The terminal device receives the query signal, and transmits an answer signal to the watch 100. When not receiving the answer signal from the terminal device, the control section of the watch 100 judges that the terminal device is a predetermined distance (in the third embodiment, 5 m, within which the antenna 5 can transmit/receive radio waves) or more away from the watch 100, and informs the user about that by a buzzer sound, flashing of a light or the like.

As described above, according to the third embodiment, a plurality of communication modes (the pairing mode, the data synchronization mode and the terminal search mode/losing prevention mode, for example) can be used under different radio wave sensitivity of the antenna 5. Accordingly, various communications can be carried out in accordance with a user's purpose or use of the watch 100.

The watch 100 in the third embodiment has a mechanical configuration as a method for adjusting the radio wave sensitivity of the antenna 5 to be suitable for the communication modes. That is, the watch 100 adjusts the radio wave sensitivity of the antenna 5 by rotating the rotating cover 32 so as to adjust the covered area of the antenna 5 covered with the shielding part. Consequently, as compared with a case where the radio wave sensitivity is changed in a communication-related module such as a reception circuit, the watch 100 can reduce the electric power consumption for adjusting the radio wave sensitivity of the antenna 5.

Furthermore, a watch is expected to be small and have a light weight (miniaturized). Hence, it is difficult to secure a space to accommodate a large battery. However, the watch 100 in the third embodiment includes the sensitivity adjustment device 102 which includes: the back-side cover main body 31 fitted to the back-side opening part of the case 1; and the rotating cover 32 disposed to cover the antenna 5, and can adjust the radio wave sensitivity of the antenna 5 with a mechanical configuration. Consequently, as compared with the case where the radio wave sensitivity is changed in a communication-related module, the watch 100 can reduce the electric power consumption. Furthermore, because the electric power consumption can be reduced, it becomes unnecessary that the watch 100 accommodates a large battery or the like. Accordingly, miniaturization of a device can be achieved.

Furthermore, the radio wave sensitivity of the antenna 5 can be adjusted by providing the rotating cover 32 of the back-side cover 30, which covers/closes the back-side opening part of the case 1, with the shielding part and the penetration part 326, and rotating the rotating cover 32. Accordingly, the radio wave sensitivity of the antenna 5 can be adjusted to be suitable for the communication modes without an additional component to adjust the radio wave sensitivity thereof, and hence simplification of a configuration of a device and miniaturization of a device can be achieved.

Furthermore, the shielding part is formed by attaching the magnetic sheet 325, which is the magnetic substance, to the back side of the rotating cover 32. Accordingly, the rotating cover 32 can be easily manufactured or the like, and hence manufacturing costs of the rotating cover 32 and the watch 100 by extension can be reduced.

In the third embodiment, the magnetic sheet 325 as the magnetic substance is disposed approximately in the shape of "C". However, the shape and disposition of the magnetic sheet 325 is not limited thereto.

Figure 35:
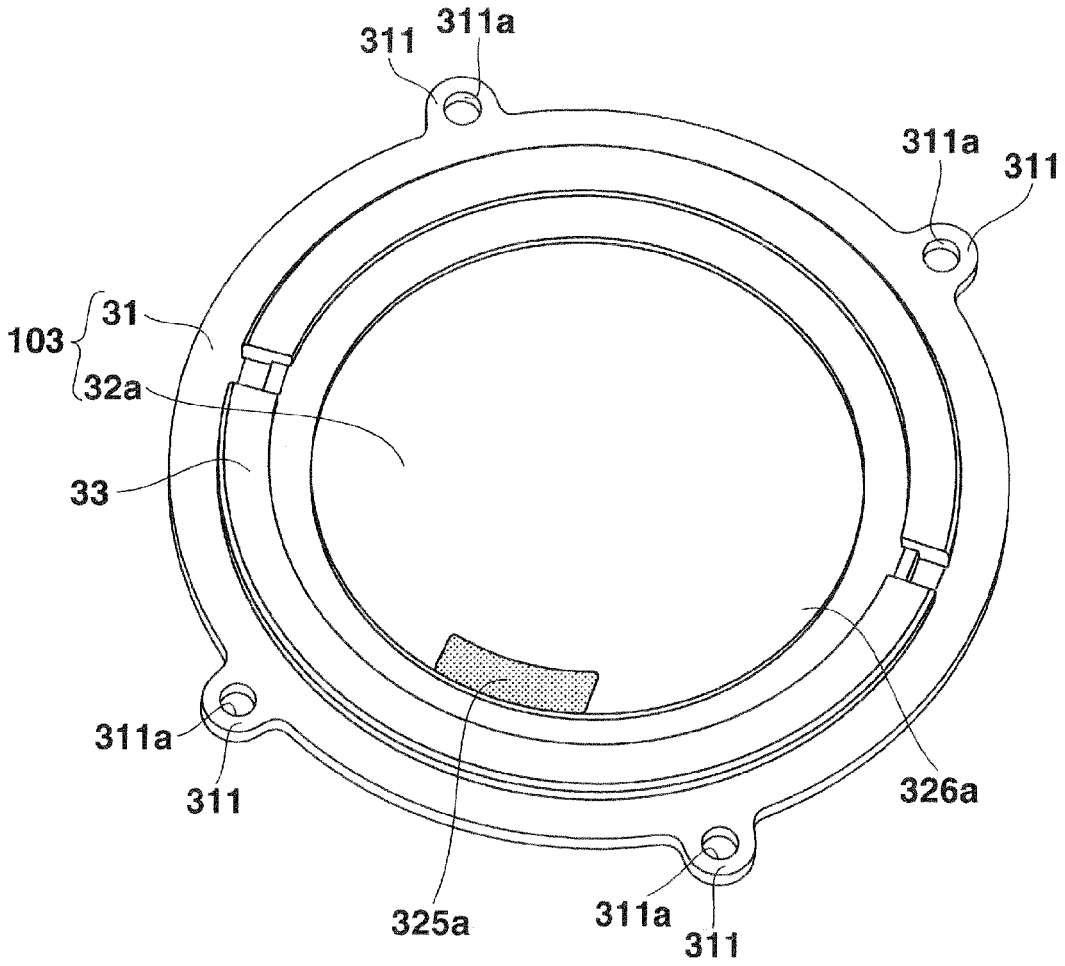
FIG. 35 is a perspective view of a rotating cover in accordance with a modification of the third embodiment.

For example, as shown in FIG. 35, only onto a part of the back side of a rotating cover 32*a* of a sensitivity adjustment device 103, a magnetic sheet 325*a* having the size with which the antenna 5 can be covered may be attached. In this case, the part where the magnetic sheet 325*a* is attached is the shielding part, and the rest is a penetration part 326*a*.

Figure 36:
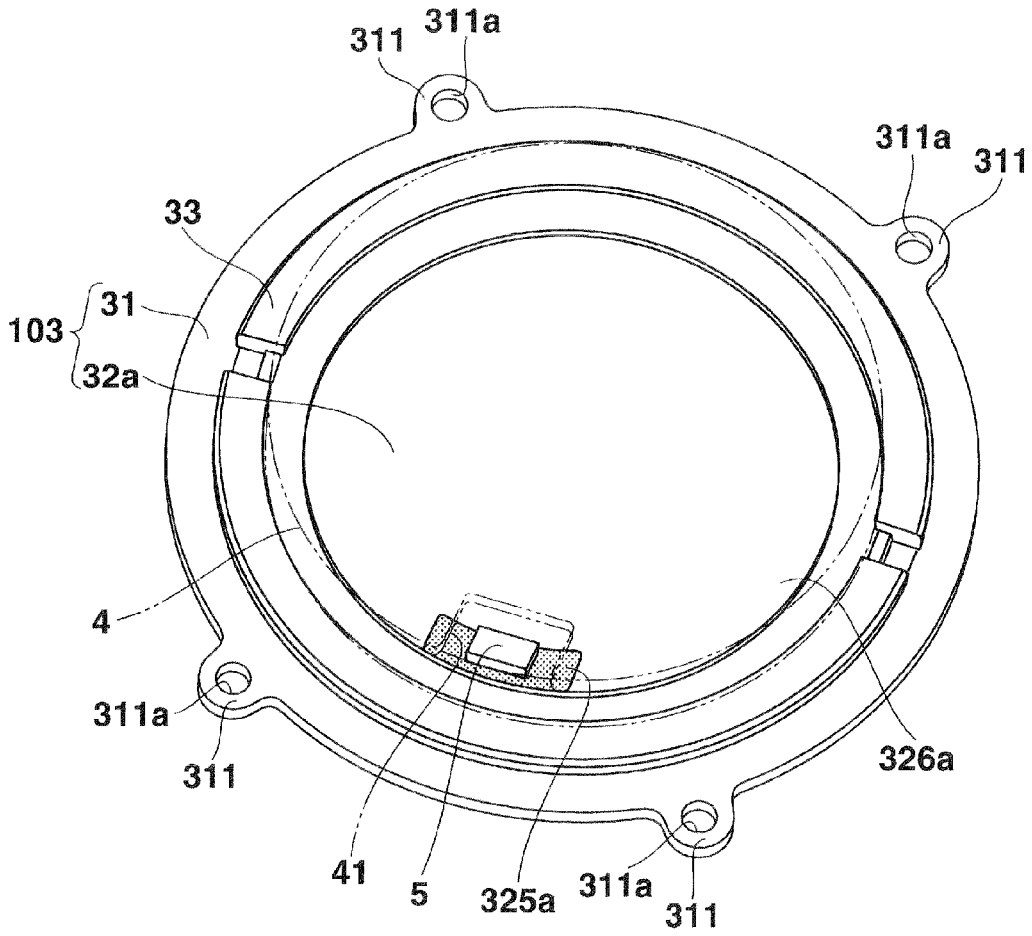
FIG. 36 is a plan view showing a positional relationship between the rotating cover shown in FIG. 35 and the antenna in a state in which the radio wave sensitivity of the antenna is low.
Figure 37:
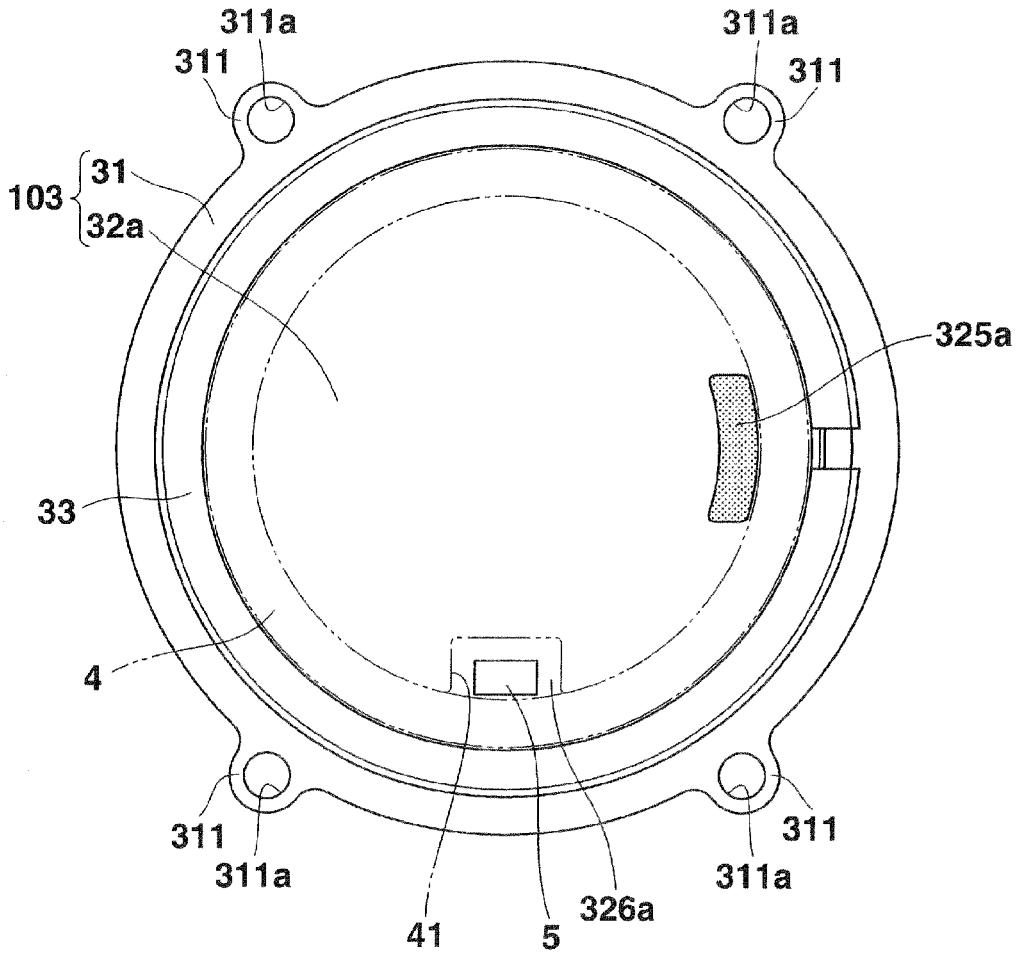
FIG. 37 is a plan view showing a positional relationship between the rotating cover shown in FIG. 35 and the antenna in a state in which the radio wave sensitivity of the antenna is high.

Therefore, when pairing is performed (namely, the pairing mode is set), as shown in FIG. 36, the rotating cover 32*a* is rotated to a point where the part where the magnetic sheet 325*a* is attached covers the antenna 5. Accordingly, the radio wave sensitivity of the antenna 5 can be decreased to be suitable for the pairing mode. When pairing is not established between terminal devices in the state shown in FIG. 36, or when data of terminal devices which already establish pairing with each other are synchronized (namely, the data synchronization mode is set), or when a terminal device (the watch 100) searches for a terminal device which already establishes pairing with the watch 100 (namely, the terminal search mode/losing prevention mode is set), as shown in FIG. 37, the rotating cover 32*a* is rotated to a point where the penetration part 326*a* (namely, the part where the magnetic sheet 325*a* is not attached) covers the antenna 5. Accordingly, the radio wave sensitivity of the antenna 5 can be increased to the extent that even terminal devices which are apart from each other can transmit/receive radio waves with each other.

In the third embodiment, the magnetic sheet 325 attached to the rotating cover 32 is the magnetic substance. However, the magnetic substance is not limited to being sheet-shaped.

Furthermore, as long as being disposed on a side (surface) of the rotating cover 32, the side facing the antenna 5, the method for disposing the magnetic substance is not limited to attachment. For example, the magnetic substance may be embedded in a part of the rotating cover 32 so as to form the shielding part. Alternatively, the magnetic substance may be disposed on the rotating cover 32, for example, by depositing or printing a magnetic material or a material including magnetic powder on the rotating cover 32 so as to form the shielding part.

Furthermore, in the third embodiment, of the rotating cover 32, the part where the magnetic sheet 325 as the magnetic substance is attached (disposed) is the shielding part, and the part where the magnetic sheet 325 is not attached (disposed) is the penetration part 326. However, the configurations of the shielding part and the penetration part are not limited thereto.

For example, the rotating cover 32 itself may be made of a radio wave shielding material which shields radio waves, and a part of the rotating cover 32 may be formed to be thicker than the rest as a thick part where penetration of radio waves is difficult as compared with the rest. The radio wave shielding material is a material which shields radio waves, such as a radio wave absorber which absorbs radio waves. More specifically, for example, the rotating ring 920 is formed by casting a magnetic material or a material including magnetic powder to be a predetermined shape or by attaching a magnetic sheet to a base material casted to be a predetermined shape. In this case, the thick part is the shielding part, and the rest is the penetration part. It is preferable to add a sensitivity indicator at a point on the back side of the rotating cover 32 (namely, the side being the outer side when the back-side cover 30 is fitted to the case 1), the point corresponding to the position of the thick part. The sensitivity indicator indicates the position of the thick part, namely, the shielding part.

Even when the thick part is the shielding part and the rest is the penetration part, the radio wave sensitivity of the antenna 5 can be adjusted by a mechanical configuration. Furthermore, a large battery or the like is not needed for adjusting the radio wave sensitivity of the antenna 5. Accordingly, miniaturization of a device can be achieved.

In the third embodiment, radio waves are shielded by disposing/attaching a magnetic substance onto a part so as to make the shielding part, and absorbing the radio waves with the magnetic loss of the magnetic material of the magnetic substance. However, as long as the shielding part shields radio waves, the configuration of the shielding part is not limited to absorbing radio waves with the magnetic loss.

Furthermore, as long as the rotating cover 32 is disposed in such a way as to cover the antenna 5, and can change the positions of the shielding part and the penetration part being rotated, thereby adjusting the covered area of the antenna 5 covered with the shielding part, the shape, size and the like of the rotating cover 32 are not limited to the shapes, sizes and the like described herein. For example, the rotating cover 32 may have the diameter smaller than that described in the third embodiment. Furthermore, the rotating cover 32 is not limited to being disposed at the approximate center of the back-side cover 30, and hence may be disposed at a point which is not the approximate center thereof, but corresponds to the position of the antenna 5.

In the third embodiment, the back-side cover 30 includes the back-side cover main body 31, the rotating cover 32, and the fixing ring 33, and the rotating cover 32 is fixed to the back-side cover main body 31 by the fixing ring 33. However, the configuration to fix the rotating cover 32 to the back-side cover main body 31 is not limited thereto.

In the third embodiment, the rotating cover 32 is provided with the concave part 328, and the rotating cover 32 is rotated by a user inserting his/her nail, a coin or the like into the concave part 32. However, the configuration to rotate the rotating cover 32 is not limited thereto. For example, the rotating cover 32 may be provided with a convex part, and the rotating cover 32 may be rotated by a user putting his/her finger on the convex part.

In the third embodiment, the case 1 of the watch 100 is approximately circular, and the back-side cover main body 31 is ring-shaped. However, the shape of the case 1 of the watch 100 is not particularly limited, and hence may be a quadrilateral, an oval, or the like. In this case too, the rotating cover 32 has a shape with which the rotating cover 32 is rotatable (for example, the shape of a disc), but the back-side cover main body 31 and the back-side cover 30 as a whole have shapes (for example, a quadrilateral, an oval, or the like) corresponding to the shape of the case 1.

Furthermore, in the third embodiment, the watch 100 is an analog watch having hands. However, the watch 100 is not limited thereto. For example, the watch 100 may be a digital watch having a liquid crystal display section constituted of a liquid crystal panel or the like, or may be a watch having hands and a liquid crystal display section.

In the third embodiment, the sensitivity adjustment device of the present invention is applied to a watch. However, a device to which the sensitivity adjustment device thereof is applicable is not limited thereto. The sensitivity adjustment device of the present invention is applicable to devices each having a case, the opening part of which is covered with a cover. For example, the present invention may be applied to various portable terminal devices such as a mobile phone and a PDA; a portable music player; a small radio; and the like.

In the embodiments, the shielding part is over the antenna 5 when communications are carried out in the pairing mode, and the penetration part is over the antenna 5 when communications are carried out in the data synchronization mode or the terminal search mode/losing prevention mode. Thus, in the embodiments, the radio wave sensitivity of the antenna 5 is adjusted with two levels. However, this is not a limit.

For example, it is possible to adjust the radio wave sensitivity of the antenna with more than two levels, by gradually adjusting the positional relationship between the shielding part and the antenna 5 so as to have a plurality of states, such as a state in which the antenna 5 is completely covered with the shielding part, a state in which the antenna 5 is partially covered with the shielding part, and a state in which the antenna 5 is not, covered with the shielding part at all. In this case, when communications are carried out in the pairing mode, but pairing is not established in the state in which the antenna 5 is completely covered with the shielding part, a user can gradually increase the radio wave sensitivity of the antenna 5 until pairing is established.

Needless to say, the present invention is not limited to the embodiments described above, and can be appropriately modified without departing from the scope of the present invention.

This application is based upon and claims the benefit of priority under 35 USC 119 of Japanese Patent Applications No. 2011-134813 filed on Jun. 17, 2011, No. 2011-134815 filed on Jun. 17, 2011, and No. 2011-185764 filed on Aug. 29, 2011, the entire disclosure of which, including the descriptions, claims, drawings, and abstracts, is incorporated herein by reference in its entirety.

What is claimed is:

1. A sensitivity adjustment device, which adjusts radio wave sensitivity of an antenna wirelessly transmitting/receiving a signal to/from an external device, the sensitivity adjustment device comprising:

a case which houses the antenna; and a ring-shaped rotating member disposed on the outside of the case in such a way as to be rotatable, the rotating member including (a) a shielding part which shields a radio wave and (b) a penetration part which allows penetration of a radio wave, wherein a positional relationship between (a) the antenna and (b) the shielding part and the penetration part is changed by rotation of the rotating member so that the radio wave sensitivity of the antenna is adjusted.

2. The sensitivity adjustment device according to claim 1, wherein the case is provided with an opening on a front side of the case, the opening is covered with a transparent member which allows penetration of a radio wave, and the rotating member is fitted to the circumference of the opening in such a way as to be rotatable.

3. The sensitivity adjustment device according to claim 1, wherein the shielding part includes a magnetic substance, which is attached to a back side of the rotating member.

4. The sensitivity adjustment device according to claim 1, wherein the rotating member includes a thick part at a part of the rotating member, the thick part being thicker than another part of the rotating member, and the thick part functions as the shielding part.

5. The sensitivity adjustment device according to claim 1, wherein the rotating member is manually operable.

6. A radio wave communication device comprising:

the sensitivity adjustment device according to claim 1; and a module to control radio wave transmission/reception of the antenna.

7. A watch comprising:

the sensitivity adjustment device according to claim 1;

a module to control radio wave transmission/reception of the antenna, and to display time, the module being disposed in the case.

8. The watch according to claim 7, wherein a rotating bezel is used as the rotating member.

9. A sensitivity adjustment device, which adjusts radio wave sensitivity of an antenna wirelessly transmitting/receiving a signal to/from an external device, the sensitivity adjustment device comprising:

a case which houses the antenna;

a rotating ring disposed in the case in such a way as to be rotatable, the rotating ring including (a) a shielding part which shields a radio wave and (b) a penetration part which allows penetration of a radio wave; and a rotation operation member which rotates the rotating ring, the rotation operation member being disposed in such a way as to pass through the case, wherein a positional relationship between (a) the antenna and (b) the shielding part and the penetration part is changed by rotation of the rotating ring so that the radio wave sensitivity of the antenna is adjusted.

10. The sensitivity adjustment device according to claim 9, wherein the shielding part includes a magnetic substance, which is attached to the rotating ring.

11. The sensitivity adjustment device according to claim 9, wherein the rotating ring includes a radio wave shielding material which shields a radio wave, and is provided with a notch or a hole at a part along a circumferential direction of the rotating ring, and the notch or the hole functions as the penetration part.

12. The sensitivity adjustment device according to claim 9, wherein the rotating ring includes a thick part at a part along a circumferential direction of the rotating ring, the thick part being thicker than another part of the rotating ring, and the thick part functions as the shielding part.

13. A radio wave communication device comprising:

the sensitivity adjustment device according to claim 9; and a module to control radio wave transmission/reception of the antenna.

14. A watch comprising:

the sensitivity adjustment device according to claim 9;

a module to control radio wave transmission/reception of the antenna, and to display time, the module being disposed in the case.

15. A sensitivity adjustment device, which adjusts radio wave sensitivity of an antenna wirelessly transmitting/receiving a signal to/from an external device, the sensitivity adjustment device comprising:

a case including an opening part, the case in which the antenna is disposed in such a way as to correspond to the opening part; and a rotating cover disposed on the opening part of the case in such a way as to be rotatable, the rotating cover including (a) a shielding part which shields a radio wave and (b) a penetration part which allows penetration of a radio wave, wherein a positional relationship between (a) the antenna and (b) the shielding part and the penetration part is changed by rotation of the rotating cover so that the radio wave sensitivity of the antenna is adjusted.

16. The sensitivity adjustment device according to claim 15, wherein the shielding part includes a magnetic substance, which is attached to the rotating cover.

17. The sensitivity adjustment device according to claim 15, wherein the rotating cover includes a thick part at a part of the rotating cover, the thick part being thicker than another part of the rotating cover, and the thick part functions as the shielding part.

18. The sensitivity adjustment device according to claim 15, wherein the rotating cover is manually operable.

19. A radio wave communication device comprising:

the sensitivity adjustment device according to claim 15; and a module to control radio wave transmission/reception of the antenna.

20. A watch comprising:

the sensitivity adjustment device according to claim 15;

a module to control radio wave transmission/reception of the antenna, and to display time, the module being disposed in the case.

* * * * *